US012435596B2

(12) United States Patent
Veenstra

(10) Patent No.: US 12,435,596 B2
(45) Date of Patent: Oct. 7, 2025

(54) WELL ABANDONMENT

(71) Applicant: Callidus Capital B.V., Heerenveen (NL)

(72) Inventor: Feitze Veenstra, Heerenveen (NL)

(73) Assignee: CALLIDUS CAPITAL B.V., Heerenveen (NL)

( * ) Notice: Subject to any disclaimer, the term of this patent is extended or adjusted under 35 U.S.C. 154(b) by 0 days.

(21) Appl. No.: 18/263,676

(22) PCT Filed: Feb. 1, 2022

(86) PCT No.: PCT/NL2022/050046
§ 371 (c)(1),
(2) Date: Jul. 31, 2023

(87) PCT Pub. No.: WO2022/164322
PCT Pub. Date: Aug. 4, 2022

(65) Prior Publication Data

US 2024/0093567 A1 Mar. 21, 2024

(30) Foreign Application Priority Data

Feb. 1, 2021 (NL) ..... 2027470

(51) Int. Cl.

| | |
|---|---|
| ***E21B 33/12*** | (2006.01) |
| ***E21B 29/02*** | (2006.01) |
| ***E21B 34/06*** | (2006.01) |
| *E21B 29/00* | (2006.01) |

(52) U.S. Cl.
CPC ..... *E21B 33/1208* (2013.01); *E21B 29/02* (2013.01); *E21B 34/06* (2013.01); *E21B 29/005* (2013.01)

(58) Field of Classification Search
CPC .... E21B 29/005; E21B 29/02; E21B 33/1208; E21B 34/06; E21B 33/12; E21B 33/134
See application file for complete search history.

(56) References Cited

U.S. PATENT DOCUMENTS

| | | | |
|---|---|---|---|
| 2,618,345 | A | 11/1952 | Tucker |
| 2,969,839 | A | 1/1961 | Greene |
| 3,079,997 | A | 3/1963 | Blydorp |

(Continued)

FOREIGN PATENT DOCUMENTS

| | | |
|---|---|---|
| GB | 1455947 | 11/1976 |
| GB | 2559355 A | 8/2018 |

(Continued)

*Primary Examiner* — Yong-Suk (Philip) Ro
(74) *Attorney, Agent, or Firm* — Quarles & Brady LLP

(57) ABSTRACT

A device for removing part of a liner or casing of a well or pile. The device includes a device body, which is arranged around a centreline of the device body and one or more hollow conduits including oxidizable material at least at a distal end. The hollow conduits are arranged for having oxygen transported therethrough from a proximal end to the distal end. The device further including a supply of oxygen arranged to supply oxygen to proximal ends of the one or more hollow conduits and a feeding module connected to the device body and the one or more hollow conduits. The feeding module arranged for feeding the one or more hollow conduits with their distal end in a direction at least partially away from the centreline of the device body.

7 Claims, 21 Drawing Sheets

(56) References Cited

U.S. PATENT DOCUMENTS

| | | | | |
|---|---|---|---|---|
| 3,231,021 | A | 1/1966 | Greene, Jr. | |
| 3,623,550 | A | 11/1971 | de Lajarte et al. | |
| 5,888,447 | A | 3/1999 | Smith et al. | |
| 11,466,530 | B2 * | 10/2022 | Wardley | E21B 23/01 |
| 11,959,352 | B2 * | 4/2024 | Mitchell | E21B 33/12 |
| 2013/0240201 | A1 * | 9/2013 | Frazier | E21B 34/063 166/135 |
| 2016/0251938 | A1 | 9/2016 | Murray et al. | |
| 2023/0050637 | A1 * | 2/2023 | Barbee | E21B 33/12 |

FOREIGN PATENT DOCUMENTS

| | | | |
|---|---|---|---|
| WO | 2016/131726 | A1 | 8/2016 |
| WO | WO-2017/199037 | A1 | 11/2017 |

* cited by examiner

WELL ABANDONMENT

RELATED APPLICATIONS

This application is a 35 U.S.C. § 371 national phase application of PCT/NL2022/050046 (WO-2022/164322 A1), filed on Feb. 1, 2022, entitled "WELL ABANDONMENT," which application claims the benefit of NL-2027470 filed Feb. 1, 2021, all of which are incorporated herein by reference in its entirety.

TECHNICAL FIELD

The aspects and embodiments thereof relate to the field of well abandonment, in particular one or more devices or methods used for abandoning a well, for example a gas or oil well, salt well or underground gas storage.

BACKGROUND

When an oil or gas well is on its end of life, the well is abandoned. To prevent oil or gas from leaking out of the abandoned well, a plug may be used to seal the well. This plug may for example comprise cement. Part of the well may be positioned near or at the surface. To reuse the ground surrounding the well at this surface, it may be preferred to remove a top of the well and to bury the remained of the abandoned well underground in a safe manner. For under water wells, it may be preferred to remove a head of the well to prevent contact with for example fish nets or anchors and the head of the well.

GB1455947A discloses a method and apparatus for removing surface defects from metal material and more particularly to a method and apparatus for instantaneously initiating such a process.

SUMMARY

It may be preferred to provide for a well abandonment method that is at least one of efficient in time and/or used energy, amount of required equipment, and/or safety, and/or one or more device which may be used for well abandonment.

A first aspect provides a device for removing part of a liner or casing of a well or pile, the device—also referred to as removal device—comprising:

- a device body, which is arranged around a centreline of the device body;
- one or more hollow conduits comprising oxidizable material, arranged for having oxygen transported therethrough from a proximal end to a distal end;
- a supply of oxygen, arranged to supply oxygen to proximal ends of the one or more hollow conduits; and
- a feeding module, connected to the device body and the one or more hollow conduits, and arranged for feeding the one or more hollow conduits with their distal end in a direction at least partially away from the centreline of the device body.

Removing part of a liner or casing may for example result in severing of the liner or casing, or in the creation of a pocket inside the liner of casing were the originally present liner or casing material was present prior to its removal. Removing part of a liner or casing may comprise melting, burning, combusting, decomposing, sublimating or otherwisely chemical reacting of the part of the liner or casing.

The device of the first aspect may be used during a well abandonment process, were one or more layers of casing and/or liner of the well has to be removed. The device may additionally or alternatively be used to remove part of a liner or casing of a pile. A well may for example be a gas well, oil well, salt well, or any other well which may be under ground and/or under water. A pile may be any hollow support structure, for example used in the oil and gas, offshore, or energy industry such as a pile or monopile for supporting a wind turbine, bumper pile, foundation pile for any structure, or any other hollow conduit in general. In general, a liner or a casing may be a conduit.

In general, a liner or casing may comprise materials such as cement, concrete, any metal, steel, plastic, granite any other material, or any combination thereof. A liner or casing may be man-made, or may also be a naturally present layer of natural present materials, such as rocks, stone or any other natural material.

The one or more hollow conduits comprise at least at a distal end oxidizable material. Oxidizable materials may be defined by that they react with oxygen to generate high temperature material, which may exceed 1000 degrees Celsius, or even 2000 degrees Celsius. These high temperatures may be used to melt and thus remove liner or casing material. To achieve the high temperatures, an oxygen concentration higher than in normal air may be required. Examples of oxidizable materials are steel, alloy steel, aluminium, any other material which allows reaction with oxygen at sufficient high temperature to melt, remove and/or damage a liner or casing, or any combination thereof.

To provide oxygen at sufficiently high concentration, the device according to the first aspect comprises a supply of oxygen, arranged to supply oxygen to proximal ends of the one or more hollow conduits. Oxygen may flow through the one or more hollow conduits from the proximal end to the distal end. The supply of oxygen may be an inlet for receiving oxygen from an external source, and may be arranged to distribute the received oxygen to one or more hollow conduits.

The supply of oxygen may for example comprise an oxygen releasing substance, for example arranged to release oxygen as a result of a chemical reaction, for example when exposed to a particular temperature or other chemical composition. The oxygen may be released in gaseous state. Oxygen may also supplied comprised in an air mixture, with a typical oxygen content of approximately 20%, which air may be at ambient pressure or at a pressure above ambient pressure.

During the reaction with the oxygen, the oxidizable material of the one or more hollow conduits may be consumed, for example as it melts away from the one or more hollow conduits. To position the distal end or distal ends of the one or more hollow conduits relative to the liner or casing that is to be removed, the feeding module is used for feeding the one or more hollow conduits with their distal end in a direction at least partially away from the centreline of the device body. Because the oxidizable material at the distal end of the one or more hollow conduits may be consumed, the distal end may change over time as the material is consumed.

As the oxidizable material is consumed, in order to keep the distal end of the one or more hollow conduits sufficiently close to the liner or casing, the hollow conduits may have to be moved towards the liner or casing. It will thus be understood that as the distal ends of the one or more hollow conduits are consumed, a new distal end is continuously formed. This new distal end may have to be moved for example to where the consumed part of the hollow conduit was positioned. Additionally, it may be required to push the distal ends of the one or more hollow conduits further away from the centreline of the device, for example as more of the liner or casing has been removed and the liner or casing has thus reduced in wall thickness.

The direction at least partially away from the centreline of the device body may correspond in a direction at least partially towards the part of the liner or casing that is to be removed. This direction may be substantially perpendicular to an elongation direction of the well or pile comprising the liner, conduit or casing that is to be removed.

The one or more hollow conduits may be formed by one or more hollow pipes. When the device comprises multiple hollow conduits, such as multiple hollow pipes, the conduits may be all similarly shaped.

A hollow conduit may have a closed circumference, or an outer circumference of a hollow conduit may be partially open. Inside a hollow conduit, more oxidizable material may be present, for example to provide for a higher density of oxidizable material in combination with a higher contact surface for reaction with oxygen—compared to when this material would be comprise by the hollow conduit itself.

When the removal device comprises more than one hollow conduit, for example more than one pipe, distal end sections of a first pipe and a second pipe may be positioned non-parallel and converging in a direction at least partially away from the centreline of the device body. A distal end section may be defined as a section of pipe adjacent to the distal end of the pipe, and may have a certain length.

When the distal end sections converge, for example towards one point of convergence, the first pipe and the second pipe may be used for removing liner or casing material near this point of convergence.

At least one, most, or all pipes may have a proximal end section positioned substantially parallel to the centreline of the device body, and a distal end section positioned at an angle relative to the centreline of the device body, in particular even substantially perpendicular to the centreline of the device body. Substantially perpendicular may be for example between approximately 60 degrees and 120 degrees relative to the centreline, between approximately 75 degrees and 105 degrees, or between approximately 80 degrees and 100 degrees relative to the centreline.

As such, one or more bends may be present and the at least one, most, or all pipes may not be entirely straight. Having a proximal end section positioned substantially parallel to the centreline of the device body may allow a pipe to have a longer length than the diameter of liner or casing of the well, conduit or pipe in which the removal device is positioned. A bending mechanism such as a wedge or fanned out skirt part may be comprised by the removal device for deforming one or more hollow bodies, optionally in combination with an actuator for moving the one or more hollow bodies relative to the bending mechanism.

As an option, the removal device may comprise a first set of pipes, which may be arranged around the centreline of the device body with proximal end sections of the pipes positioned substantially parallel to the centreline of the device body and distal end sections of the pipes positioned substantially perpendicular or at least at an angle relative to the centreline of the device body, and wherein the proximal end sections of pipes in the first set of pipes may be arranged on a circle with a first diameter. The circle with the first diameter may have a centre aligned or approximately aligned with the centreline of the device body.

As a further option, the removal device may comprise a second set of pipes, which is arranged around the centreline of the device body with proximal end sections of the pipes positioned substantially parallel to the centreline of the device body and distal end sections positioned substantially perpendicular to the centreline of the device body, wherein the proximal end sections of pipes in the second set of pipes are arranged on a circle with a second diameter, which second diameter is larger than the first diameter. The circle with the second diameter may have a centre aligned or approximately aligned with the centreline of the device body.

As an even further option, which as with all optional features may be readily combined with other optional features, distal ends of the one or more pipes may be positioned or generally disposed on a circle. This circle may have a third diameter, which third diameter is larger than the second diameter.

At least two of the hollow conduits may be connected in a direction substantially perpendicular to a flow direction for oxygen through the hollow conduits. As an even further option, all or most of the hollow conduits may be connected in a monolithic or single body, which may be manufactured by interconnecting separately formed hollow conduits, additive manufacturing, extrusion, connecting curved sheets, any other manufacturing method or any combination thereof.

In a particular embodiment, the one or more hollow conduits may be formed by at least two sheets or sheet-shaped parts, of which at least one is a curved sheet or curved sheet-shaped part, wherein the at least two sheets or sheet-shaped parts are connected to each other such that at least one hollow chamber is formed between the two sheets or sheet-shaped parts by the at least one curved sheet or sheet-shaped part.

A cross-sectional shape of the hollow conduits may differ between the proximal end and the distal end of the one or more hollow conduits. In particular when the proximal end section and the distal end section of a hollow conduit are oriented at an angle relative to each other, the cross-section shape may differ.

The one or more hollow conduits may be arranged to be rotated around the centreline in the liner. For example, the entire removal device or the device body may be arranged to be rotated around the centreline in the liner. As such, an entire circumference of a liner or conduit may be removed, even if the device comprises only one or a small number of hollow conduits.

As a particular option, the feeding module may comprise an actuator and a wedge or other bending member over which a hollow conduit may be bent. The actuator may be arranged to move the wedge and the one or more hollow conduits relative to each other. The movement of the wedge relative to the one or more hollow bodes may be used to move distal ends of the one or more hollow conduits in a direction at least partially away from centreline of the device body.

Any feeding module may be arranged to move one or more hollow conduits at a particular feeding speed. For example, the feeding speed may be higher than a speed with which the distal ends of the one or more hollow conduits are burned away. This may result in an increase in radial distance between the centreline and the distal ends.

As another example, the feeding speed may be approximately equal to the speed with which the distal ends of the one or more hollow conduits are burned away. This may result in an approximately constant radial distance between the centreline and the distal ends. In the latter example, when the distal ends are also moved axially relative to the conduit, liner, or casing in which they are positioned, a pocket with a inner shape, for example inner radius, corresponding to a radial position of the distal ends of the one or more hollow conduit may be formed by removal of material. The pocket may have an inner radius which is larger than an outer diameter of the liner, conduit or casing in which the removal device is positioned.

The wedge and the one or more hollow conduits moving relative to each other may imply than either the wedge is moving, the one or more hollow conduits are moving, or both are moving. As such, one of the wedge and the one or more hollow conduits may be connected to the actuator as an actuator may in general be used to constitute a movement, for example by applying a force.

As a particular option, the removal device may in its entirety be moved relative to the conduit, liner, well, pipe, or casing in which it is present during the removal process, e.g. when distal ends of the hollow conduits are combusting. As such, over a particular axial distance, material may be removed.

The actuator may for example be a hydraulic, pneumatic or electric actuator. The energy required for operating the actuator may be supplied to the actuator via a conduit arranged to transport for example hydraulic fluid, pneumatic pressure, pressurised gas such as oxygen, nitrogen, any other gas, or any combination thereof, an electric current, or any other substance for transporting energy to the actuator, for example thermal energy and/or chemical energy.

When the one or more hollow conduits are connected to the device body, the actuator may be arranged to move the wedge relative to the device body, and part of the one or more hollow conduits may lie over an outer surface of the wedge. As such, the outer surface of the wedge may define the bend in the one or more hollow conduits, as the one or more hollow conduits may be pushed over this outer surface by the actuator.

When the wedge is moved, for example in use in a direction upwards, the distal ends of the one or more hollow may also be moved in the same direction. As such, a pocket of liner or casing material may be removed.

Alternatively, when the wedge is connected to the device body, the actuator may be arranged to move the one or more hollow conduits relative to the device body, and part of the one or more hollow conduits may lie over an outer surface of the wedge. In this embodiment, the position of the distal end or distal ends of the one or more hollow conduits and/or the wedge relative to an elongation direction of the liner or pipe may remain substantially the same while the distal end or distal ends are moved away from the centreline of the device body, i.e. towards the liner or casing, for example because in use the distal ends may be consumed in the combustion process with the oxygen.

As an even further option, any embodiment of a removal device may comprise an ignition module arranged to ignite a combustible substance at the distal ends of the one or more hollow conduits. The combustible substance may be arranged to react exothermally for generating sufficient heat for igniting the oxidizable material comprised by the distal end or distal ends of the one or more hollow conduits. For example, thermite may be used as a combustible substance and for any combustible substance, a heating device such as an electrical resistance through which a current is fed may be used for starting the exothermal reaction of the combustible substance.

The ignition module may additionally or alternatively comprise a current generator of which a first pole is arranged to be electrically conductively connected to distal ends of the one or more hollow conduits, and of which a second pole has a polarity opposite to the polarity of the first pole, which second pole is arranged to be connected to the liner, pipe or conduit in which the ignition module is positioned. The second pole may alternatively be the ignition module itself.

The current generator may be arranged to supply a sufficiently high current to create an electric arc between the liner and the distal ends of the one or more hollow conduits for heating and/or melting the distal end or distal ends of the one or more hollow conduits. A current may also be used for increasing a temperature of the distal end of one or more hollow bodies to increase a reaction speed with the oxygen to start oxidation of the distal ends.

A second aspect provides a method for removing part of a liner or casing of a well or pile, the method comprising the steps of:

- positioning a device for removing or severing a liner of a well or pile in the well or pile, for example a removal device according to the first aspect;
- supplying oxygen to a distal end of at least one hollow conduit comprising oxidizable material comprised by the device, for example by supplying oxygen to a proximal end of the at least one hollow conduit and allow flow of oxygen from the proximal end to the distal end;
- igniting the distal end of the at least one hollow conduit to allow combustion of the distal end of the at least one hollow conduit; and
- removing part of the liner by operating a feeding module of the device such that the distal end of the at least one hollow conduit is moved towards an inner wall of the liner.

With the method, the liner may be fully severed, or only partially. When a liner is only partially severed, a pocket may have been created inside the liner. When the well or pile comprises a plurality of coaxial liners or casings, at least part of one or more of these liners or casings may be removed using the method according to the second aspect.

In general, a liner or casing, or conduit, or pile may have any size and any cross-sectional shape, such as circular and non-circular, for example rectangular or any other shape.

As an option, embodiments of methods may comprise rotating the at least one hollow conduit in a direction parallel to an elongation direction of the liner during combustion of the distal end of the at least one hollow conduit, optionally while the distal end of the at least one hollow conduit is moved towards an inner wall of the liner. As such, a larger part of the circumference or even 360 degrees of the circumference of the liner may be removed by the distal end of the at least one hollow conduit, even if the device only comprises one or a small number of hollow conduits.

The operating of the feeding module may comprise controlling an actuator of the feeding module for moving a wedge relative to the one or more hollow conduits, wherein the movement of the one or more hollow bodies relative to the wedge moves distal ends of the one or more hollow bodies towards the inner wall of the liner.

The igniting of the distal ends of the at least one hollow conduit comprises at least one of igniting an exothermally combustible substance at the distal ends of the one or more hollow conduits; and feeding a current between the liner and the distal ends of the one or more hollow conduits.

The positioning of the device for removing part of a liner of a well or pile in the well or pile may comprise suspending the device from a cable attached to a cable attachment point of the device, in particular comprised by the device body, and lowering the device into the liner. The cable may be a conduit used for supplying any of oxygen, hydraulic fluid, pneumatic pressure, electrical current, or any combination thereof to the device.

Additionally or alternatively, a suspension mechanism may be used for suspending the removal device from. The suspension mechanism may comprise bars, tubes, beam, any other structural component, or any combination thereof. The suspension mechanism may comprise one or more conduits, for example for supply oxygen, hydraulic fluid, gas, any other matter, or any combination thereof to the removal device. The suspension mechanism may be connected to the well at or near the head of the well, for example to a casing of the well or to the well head or part of the well which is above ground.

A method according to the second aspect may further comprise removing part of a liner, casing or conduit using a device according to the sixth aspect. This particular part may be oriented substantially perpendicular to the centreline of the liner, casing or conduit, and may for example be an end cap, lid, seal, rock bed, for example present below the well, or any other element.

A third aspect provides a device for placing a seal plug in any conduit, for example a liner of a well, a pipe, a pipeline or any other hollow body, the device comprising:

a seal plug arranged to form a circumferential seal against an inner wall of the liner in an unrestricted state, the seal plug comprising a radial clamping mechanism for clamping the seal plug in the liner, the radial clamping mechanism comprising at least one clamping member; and a clamping mechanism restriction member for holding the radial clamping mechanism in a restricted state, wherein the radial clamping mechanism has a smaller outer footprint in the restricted state than in the unrestricted state;

wherein the restriction member comprises a hollow chamber with an inlet for receiving a flow of fluid, such as sealant, water, any other liquid, small solid particles which may flow through a conduit, any gas, any other fluid, or any combination thereof and an outlet passage arranged to allow passage of the radial clamping mechanism, and the radial clamping mechanism is positioned at least partially in the hollow chamber between the inlet and the outlet passage.

The seal plug may be used as a bottom for a cement plug which may be formed on top of the seal plug. As such, the seal plug may be arranged to provide a substantially leakproof seal preventing or restricting a flow of fluid, such as sealant, between the seal plug and an inner wall of the liner.

The clamping mechanism restriction member, also referred to as restriction member, may be substantially cylindrically shaped with the hollow chamber protruding into the bottom of the cylinder. The inlet may be positioned on the opposite side of the bottom—i.e. the top of the cylinder in use.

The outer footprint of the radial clamping mechanism may for example be an outer diameter of the radial clamping mechanism. The outer footprint of the radial clamping mechanism in unrestricted state may be equal to or larger than an inner footprint of the liner, for example an inner diameter of the liner. As such, the unrestricted state may imply that the radial clamping mechanism is no longer restricted by the restriction member, but may still be restricted by an inner wall of the liner and may thus still be at least partially for example elastically deformed. Also when restricted by the restriction member, the radial clamping mechanism may be at least partially elastically deformed.

At least one, multiple or all clamping members may be at least partially frustoconically shaped in the unrestricted state, and is arranged to be elastically deformed into the restricted state. The frustoconical shape may comprise a hollow chamber and/or recess therein.

The radial clamping mechanism may comprise at least two clamping members, which are positioned at different distances from the inlet of the restriction member. When two clamping members are positioned at different distances from the inlet, first a first of the clamping members may become unrestricted, followed by a second of the clamping members after a particular amount of time.

At least one clamping member may be connected to the seal plug with a biasing member arranged to bias the clamping member in the unrestricted state. A biasing member may for example be or comprise one or more springs, torsion springs, or other elastic elements with a particular spring force as a biasing force for biasing the clamping member in the unrestricted state. In the unrestricted state, the clamping member may be pushed against an inner wall of the liner by the biasing member. As such, a friction force may be formed between the clamping member and the inner wall which may keep the seal plug in place in the liner.

At least one, multiple or all clamping members may be arranged to form the circumferential seal against the inner wall of the liner in the unrestricted state. As such, a clamping member may have one or more of three functions: clamping the seal plug in the liner, forming the seal against leakage of sealant or other fluid, and preventing movement or deformation of another clamping member. The latter function may for example be performed by one or more split springs.

A fourth aspect provides a method for placing a seal plug in a liner of a well, the method comprising the steps of:

lowering a device for placing a seal plug into the liner of the well, in particular a device according to the third aspect;

providing a flow of fluid, such as sealant, such as cement or any other filling fluid, to an inlet of a hollow chamber of a restriction member of the device for placing the seal plug; and allowing the seal plug to move relative to the restriction member by virtue of the hollow chamber becoming filled with fluid, to release the seal plug into an unrestricted state wherein the seal plug forms a circumferential seal against an inner wall of the liner.

The movement of the restriction member relative to the seal plug may for example be an upward movement of the restriction member relative to the seal plug. As such, the seal plug may also move downward relative to the restriction member. As an option, the seal plug may remain substantially at the same position during the movement of the restriction member.

The flow of fluid, such as sealant, may be constituted by a pump and/or gravity, and during the flowing, the fluid, such as the sealant or cement, may be in a substantially fluid state. The fluid may fill the hollow chamber of the restriction member and the fluid in the hollow chamber may push at least part of the seal plug out of the restriction member.

Examples of sealant are cement, bentonite, clay water, sealant water, an open or closed cell foam, a gaseous foam, any other matter which may be in fluid state and after some time become at least partially solid, any other sealing material or any combination thereof. For pushing the seal plug out of the restriction member, the fluid may be any fluid matter, including liquids, solids, gasses, and any combination thereof.

In an embodiment of the method according to the fourth aspect, the seal plug comprises a radial clamping mechanism which in unrestricted state forms the seal with the inner wall of the liner to restrict sealant or any other fluid from flowing between the radial clamping mechanism and the inner wall of the liner.

A fifth aspect provides a method for abandoning a well. The method comprises placing a seal plug in a liner of the well, for example according to the method according to the fourth aspect. After or prior to the seal plug has been placed, the method may further comprise a step of severing or removing a section of the liner of the well according to the method according to the second aspect, and removing the severed section of the liner.

A method according to fifth aspect may further comprise opening up the well by removing part of a top seal of the well, using a device according to the sixth aspect.

A sixth aspect provides a device for removing material, comprising a plurality of hollow conduits, which are connected to a frame at or near proximal ends of the hollow conduits. The plurality of hollow conduits, when regarded in a top plan view, are positioned as a bundle, or substantially on a perimeter of a polygon such as a circle. By igniting distal ends of the hollow conduits and feeding oxygen to the distal ends, for example through the hollow conduits, material may be removed. In particular, material of an element against which the distal ends are forced may be removed. The forcing may be for example by virtue of gravity pulling on the mass of the removal device, and/or by an additional actuator forcing the distal ends against the material that is to be removed.

It will be understood that options and features disclosed in conjunction with a device may be applied to embodiments of a method in which such a device is used, and vice versa. Different aspects may be applied or used in conjunction with other aspects, or on their own. Options disclosed in conjunction with a device according to one aspect may be readily applied to devices according to other aspects, such as but not limited to an ignition module, feeding module, actuator, clamping member, supply of oxygen, hollow conduit, any other feature, or any combination thereof.

In general, any device such as a removal device or device for placing a seal plug or any component thereof may be approximately rotationally symmetric around a centreline of said device, and/or a centreline of a conduit, liner or casing in which the device is positioned.

BRIEF DESCRIPTION OF THE FIGURES

In the figures.

DETAILED DESCRIPTION OF THE FIGURES

Figure 1:
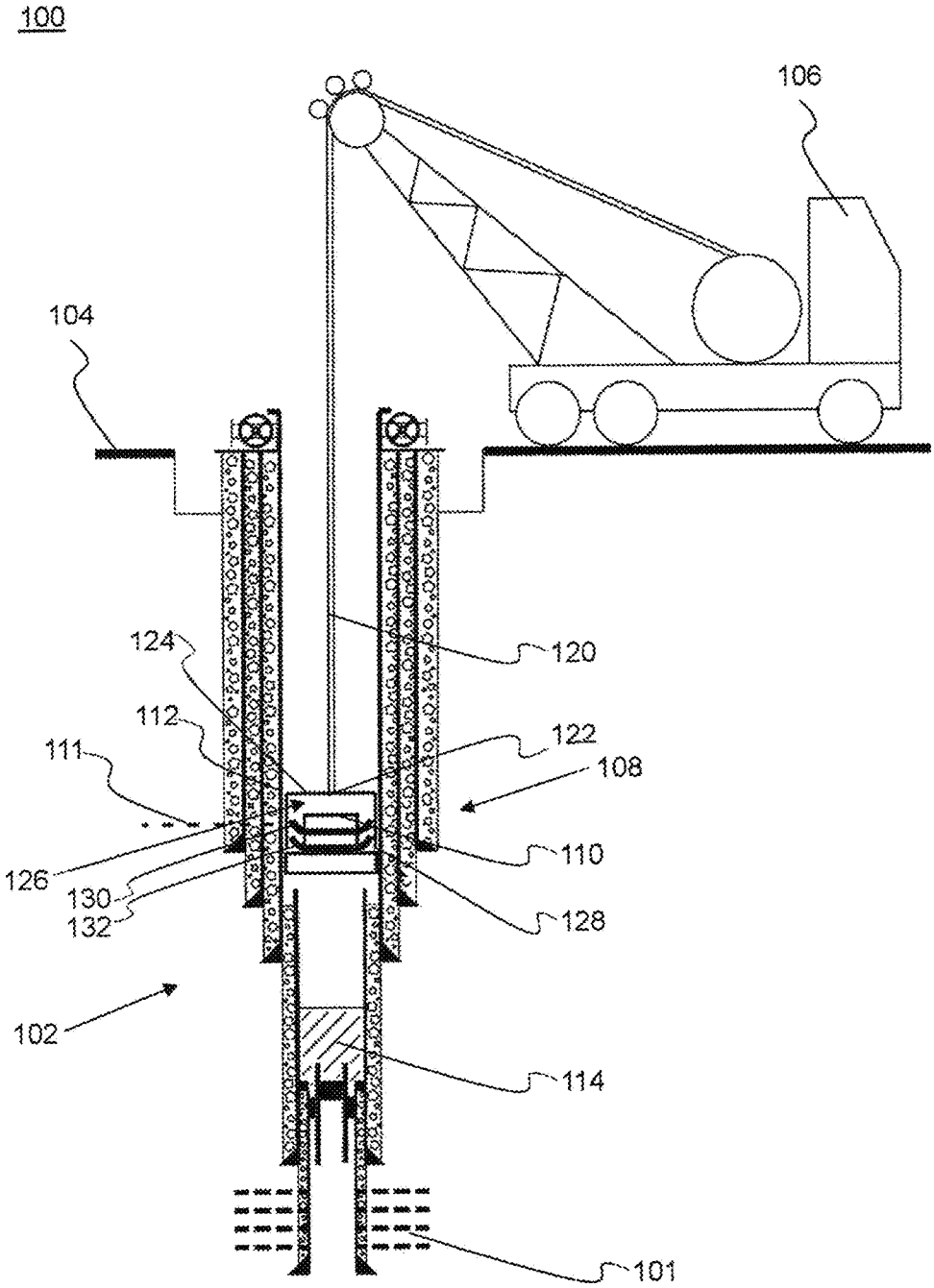
FIG. 1 schematically depicts a cross-section of a well abandonment site.

FIG. 1 schematically depicts a cross-section of a well abandonment site 100. A well 102, for example a production well, is positioned underground, i.e. beneath the surface 104 of the earth were oil or gas 101 may be or have been present. Suspended from a crane 106, a device 108 for placing a seal plug 110 in a liner 112 of the well 102 is positioned in the well 102.

The well 102 may comprise any number of liners and/or casings, which may be positioned at least partially coaxially. In a lower section of the well 102, an end plug 114 may be positioned, for example to prevent leakage of oil and/or gas into the well 102.

The device 108 for placing the seal plug 110 is in this example suspended from a sealant conduit 120 as an example of a fluid conduit through which sealant can be transported to an inlet 122 of a clamping member restriction member 124 comprised by the device 108 for placing the seal plug 110—also referred to as the placement device 108. The seal plug 110 is partially positioned in a hollow chamber 126 of the restriction member 124. The inlet 122 is arranged for receiving a flow of sealant as a fluid into the hollow chamber 126. In this embodiment opposite to the inlet 122, an outlet passage 128 is comprised by the restriction member 124. The outlet passage 128 allows passage of part of the seal plug 110 out of the restriction member 124. As shown in FIG. 1, the restriction member 124 may have a substantially U-shaped cross-section.

When air or any other gas is present in the sealant conduit 120 prior to the sealant or any other fluid flowing through the sealant conduit 120, this air may be compressed under the weight of the sealant and optionally pressure provided by a pump, such as the pump used for pumping the sealant or any other substance or fluid. The resulting pressurised air may be used for pressing at least part of the seal plug 110 out of the restriction member 124. However, preferably, substantially no air or gas is present in the sealant conduit 120 and hollow chamber 126 while the device 108 is lowered. An air vent 125, as explained in conjunction with FIG. 2A, may be use to vent air or other gas from the hollow chamber 126, preferably before the device 108 is lowered more than a length of the device 108 into the well. This may allow the air vent 125 to be closed by an operator at ground level.

The seal plug 110 comprises a first clamping member 130 and an optional second clamping member 132 as a radial clamping mechanism. In FIG. 1, the radial clamping mechanism is depicted in a restricted state, wherein an outer shape, in particular an outer diameter, of the first clamping member 130 and the optional second clamping member 132 is restricted by the restriction member 124.

The first clamping member 130 is positioned closer to the inlet 122 than the second clamping member 132. As an option, both clamping members are substantially frustoconically shaped, with a hollowed out centre. The clamping members may comprise or consist of resilient or elastic material, such as rubber. In the restricted state, at least part of a clamping member may be elastically deformed. A clamping member may as an option be substantially flat shaped in an unrestricted state, and may be bent into the restricted state.

The inlet 122 may be provided with an inlet valve. When for example cement as a sealant is poured through the sealant conduit 120 towards the inlet 122, the inlet valve may restrict or block flow of fluid, such as the flow of sealant, into the hollow chamber 126 until a predetermined pressure is applied to the inlet valve. This predetermined pressure may correspond to a weight of a column of sealant in the sealant conduit 120 pressing down on the inlet valve, for example when the seal plug 110 is at a desired position 111 in the well 102 which may correspond to a desired depth. Alternatively or additionally to the weight of the column of sealant, any other pressure such as a gas pressure may press down on the inlet valve.

Figures 2A, 2B:
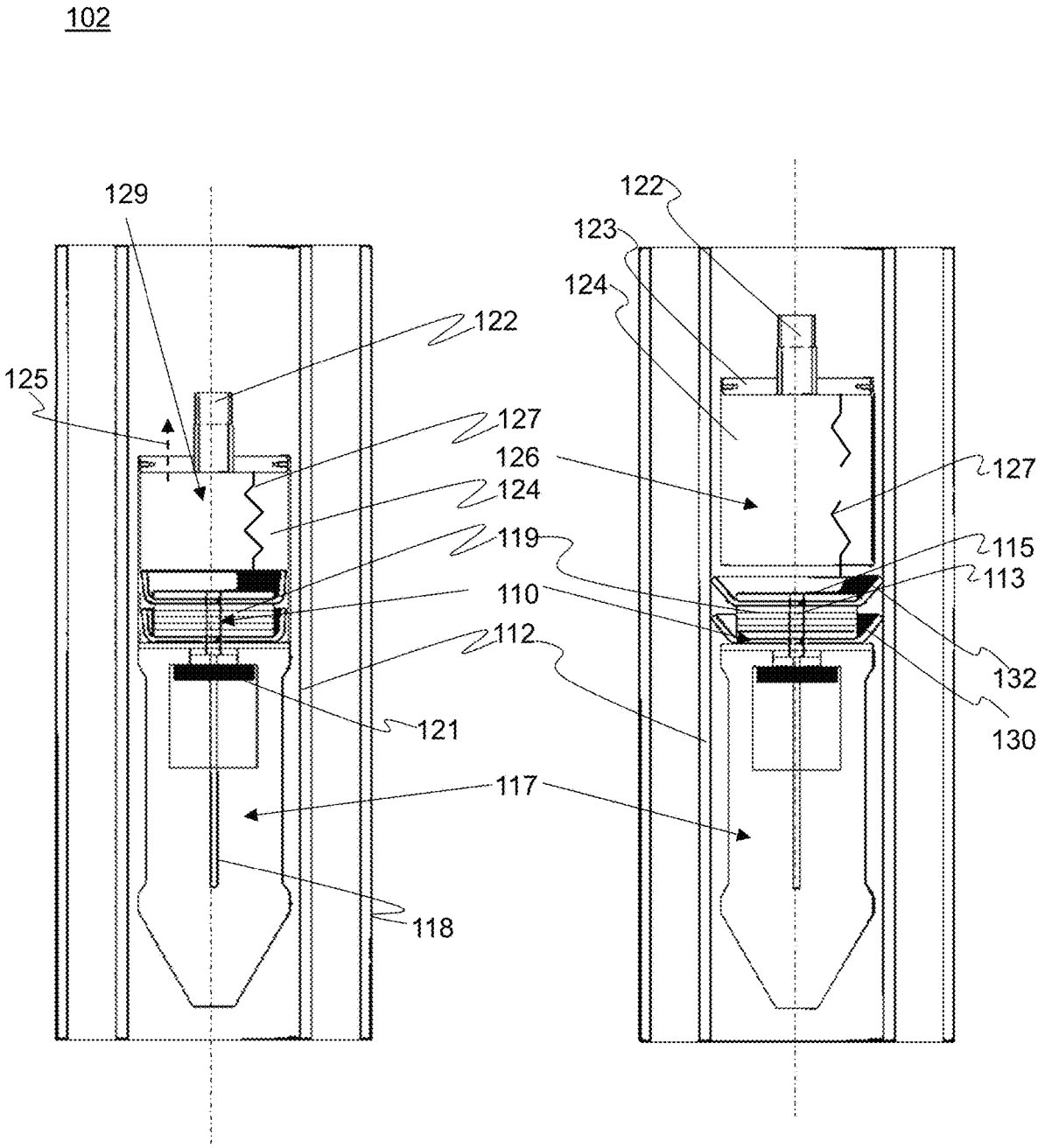
FIGS. 2A and 2B show a detailed view of a placement device in a well in a cross-sectional view.

FIGS. 2A and 2B show a detailed view of the placement device 108 in the well 102 in a cross-sectional view. FIGS. 2A and 2B depict the radial clamping mechanism respectively in a restricted state by the restriction member 124 and in an unrestricted state.

In the particular embodiment of FIGS. 2A and 2B, the radial clamping mechanism comprises the first clamping member 130 and the second clamping member 132.

As an option shown in FIGS. 2A and 2B, the seal plug 110 comprises a seal plug body 117 comprising two plate elements 118 of which at least one has a slit in which the other of the plate elements may be inserted. As such, in a cross-sectional view perpendicular to the view of FIG. 2A, the plate elements 118 may form a cross. With the plate elements, a simple and economical design may be achieved.

A protrusion 113 may extend from the seal plug body 117 on which the clamping members 130, 132 may be connected. For example, a clamping member may comprise a through hole through which the protrusion 113 may extend. One or more spacer rings 119 may be used to create a desired distance between the first clamping member 130 and the second clamping member 132. An end ring 115 may be used to fix the spacer rings 119 and the clamping members 130, 132 on the protrusion 113. For example, a threaded, glued, welded, bolted, or any other type of connection may be used. The seal plug body 117 may be tapered at an in use bottom end to facilitate insertion of the seal plug into the liner 112.

The protrusion 113 may alternatively be a separate component, such as a bolt or rod, which may be at least partially threaded. A bottom ring 121 may be provided on which the seal plug body 117, optional spacer rings 119, one or mere clamping members are stacked, and connected using the protrusion 113 or rod and the end ring 115.

As an option, a lid section 123 may be disconnect able to the restriction member 124. The inlet 122 may be connected to the lid section 123. When the lid section 123 is disconnected from the restriction member 124, the seal plug 110 may be positioned into the restriction member 124 in the same direction as the direction with which the seal plug 110 leaves the restriction member 124 in use. After the seal plug 110 is positioned into the restriction member 124, the lid section 123 may be connected to the restriction member 124.

A further optional feature depicted in FIG. 2A, and schematically depicted as a dashed arrow, is an air vent 125, which air vent 125 is in particular positioned in the lid section 123. An air vent 125 may for example be embodied as a through-hole. The air vent 125 allows air or other gasses to be vented from a space 129 between the clamping member 132 and the restriction member 124, in particular when an essentially substantially air-tight seal has been achieved between the clamping member 132 and the restriction member 124. When a space 129 between the clamping member 132 and the restriction member 124 is filled with a fluid, for example via the inlet 122, the air vent 125 allows air to be removed from the restriction member 124, such that the volume previously occupied with air or other gas can be filled with fluid. In general, it is preferred to have no air or at least a significantly low volume of air trapped in the restriction member 124, because due to air present in the restriction member 124, the restriction member 124 may otherwise float in a liquid present in the liner which would prevent the lowering of the device 108 to the desired depth.

In general, a flow of fluid may be provided to the restriction member 124 prior to lowering the device 108 for placing the seal plug into the well, or when the device is lowered approximately only the length of the device or less into the well. As such, air may be removed through the air vent approximately at ground level. The air vent 125 may comprise an operable valve for closing the air vent 125. The air vent 125 may be closed using a closing member such as a screw, a plug, or any other object arranged for sealing a hole or passage. The air vent 125 may in particular be closed by an operator at or near the ground surface 104.

An even further optional feature depicted in FIGS. 2A and 2B is that a temporary connection member 127 is connected between the restriction member 124 and the clamping member 132. In use, the temporary connection member 127 prevents the clamping member 132 from being released from the restriction member 124 when an insufficient force is provided to break or rupture the temporary connection member 127. The temporary connection member 127 may hence be arranged to fail under a certain load. When the temporary connection member 127 has failed, the restriction member 124 can be lifted up and away from the seal plug 110. The temporary connection member 127 may be at least partially elastically deformed when the plug 110 moves away from the restriction member 124. The temporary connection member 127 may be embodied as a spring, or at least comprise a spring or other resilient element.

When the device 108 is lowered into the well, fluid is preferably already present in the hollow chamber 126 of the restriction member 124, and in the sealant conduit 120. When the device 108 decelerates during the lowering, and for example comes to a standstill, a hydraulic shock may occur in this fluid. Hydraulic shock is caused when a fluid in motion, for example fluid in the hollow chamber 126 being lowered, is forced to stop or even change direction suddenly. The temporary connection member 127 may be arranged to dissipated energy from such a hydraulic shock. If the energy from the hydraulic shock is insufficiently dissipated, the seal plug 110 may be pushed out of the restriction member at an undesired depth. The temporary connection member 127 can for example dissipate energy by being plastically deformed, and/or by elastic deformation.

The temporary connection member 127 may be embodied as a shear pen connected between the device 108 and the plug 110. In particular, the temporary connection member 127 may comprise one or more materials with a high toughness—i.e. a high ability to absorb energy and plastically deform without fracturing or rupturing. Examples of high toughness materials are metals, such as nickel, rubbers, composites, and polymers such as polyethylene.

Figure 3:
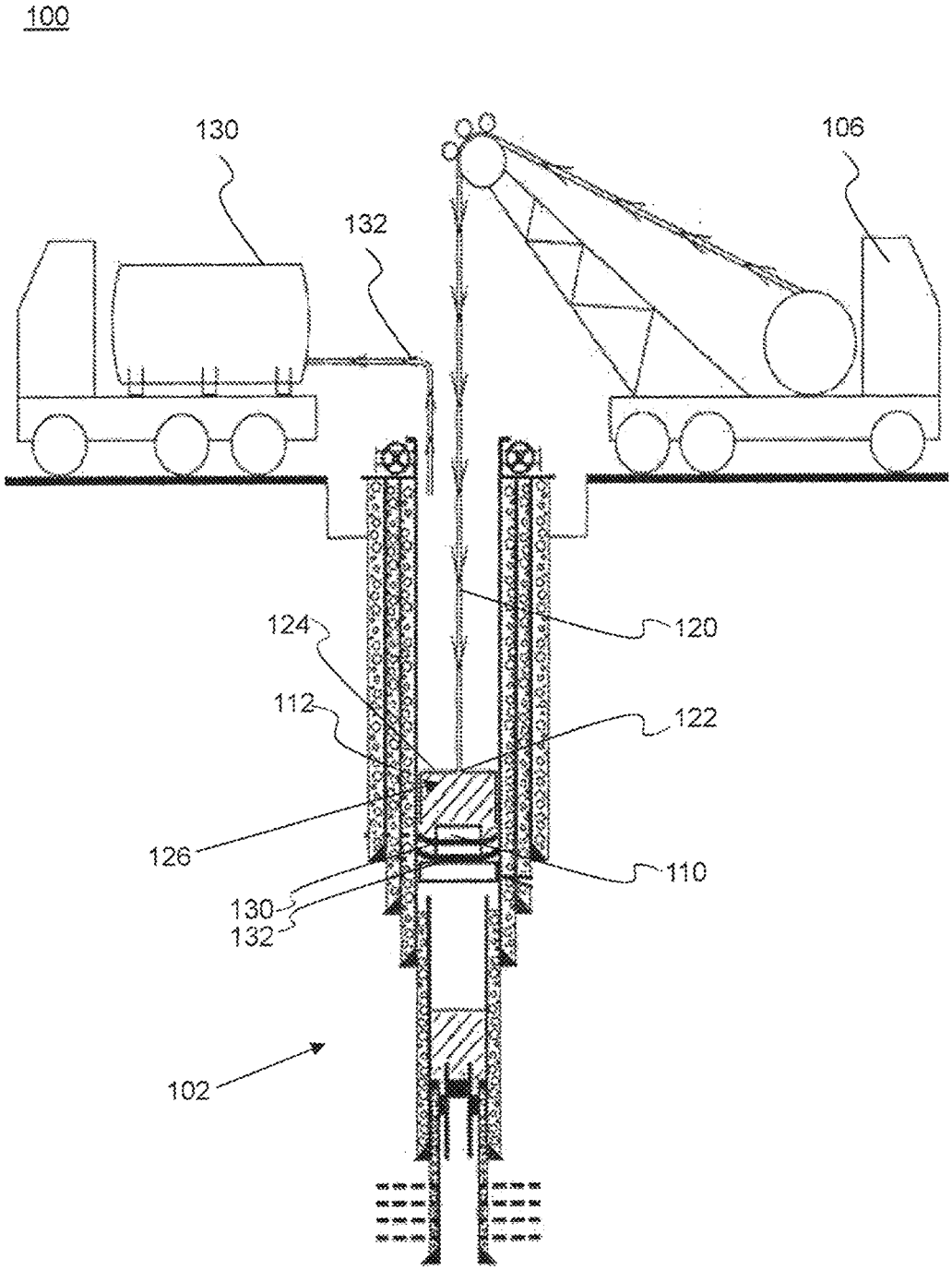
FIG. 3 depicts the well abandonment site in a further stage of the well abandonment.

FIG. 3 depicts the well abandonment site 100 in a further stage of the well abandonment. Now, sealant has been supplied to the hollow chamber 126 through the sealant conduit 120 and the inlet 122 of the restriction member 126—which is indicated with the arrows in the conduit 120 in FIG. 3. When sufficient sealant, such as cement, is supplied to the hollow chamber 126, the restriction member 124 may rise relative to the seal plug 110. The sealant is shown hatched in FIG. 3.

When two or more clamping members are comprised by the seal plug 110, first the second clamping member 132 may become unrestricted due to the rising of the restriction member 124 while the first clamping member 132 is still present in the hollow chamber 126. Subsequently, the first clamping member 130 which is nearer to the input 122 than the second clamping member 132 becomes unrestricted. This may allow the position of the seal plug 110 to generally always be defined, by connection to the restriction member 124, liner 112 or any other conduit in which the seal plug is positioned, or both.

Alternatively, for example when a single clamping member is used, in a small timeframe when the clamping member transitions between the restricted state and the unrestricted state, the seal plug 110 is not connected to the liner 112 nor to the restriction member 124. The transition time between the restricted state and the unrestricted state may be sufficiently short to prevent significant movement of the seal plug 110 in the liner 112.

Optionally, a step of draining the well 102 may be performed for example when sealant and/or any other fluid is supplied into the well. An optional draining truck 130 may be used for draining fluid from the well 102, for example using a pump and a hose 132 connected to the pump. An upstream end of the hose 132 may be placed in the well 102. If no draining is used, any fluid which may be present in the well may be pushed out of the well due to sealant or any other fluid entering the well. The flow of fluid through the hose 132 is indicated with the arrows in the hose 132 in FIG. 3.

While the fluid such as sealant, e.g. cement, is flowing through the conduit 120, the restriction member 124 may be lifted upwards. In general, the restriction member 124 may be lifted using the conduit 120, any other cable, line, chain, rope or any other lifting member, or any combination thereof.

At least one clamping member may be arranged to form a circumferential seal against an inner wall of the liner 112 in the unrestricted state. Alternatively, a separate circumferential seal may be comprised by the seal plug 110, which separate circumferential seal may also be positioned in the restriction member in a restricted state prior to being deployed into an unrestricted state wherein the separate circumferential seal forms a circumferential seal against an inner wall of the liner 112. By using the flow and/or weight of cement for placing the seal plug 110 in the unrestricted state, no additional actuator may be required for placing the seal plug 110 in the unrestricted state.

Figure 4:
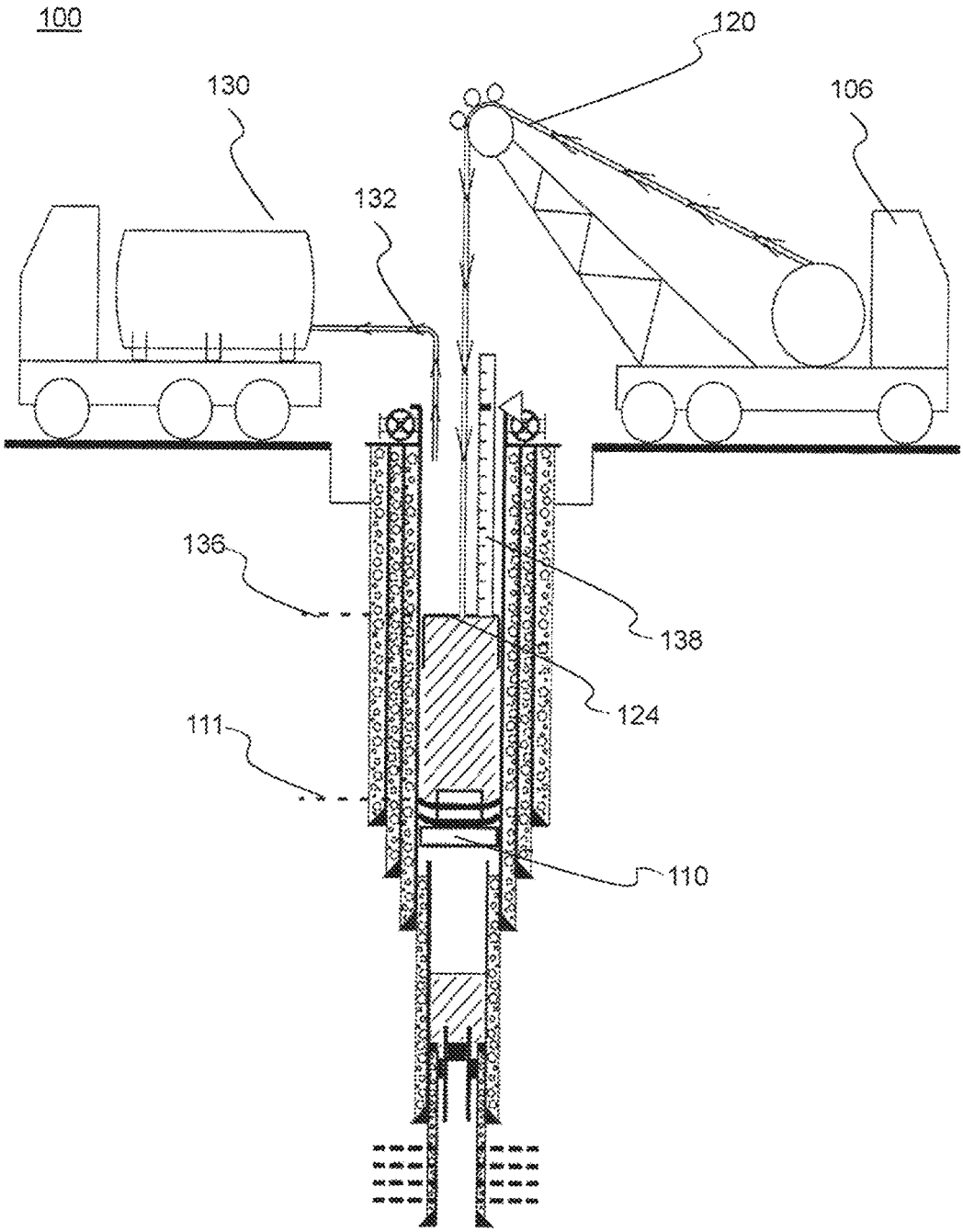
FIG. 4 schematically depicts yet a further stage in the well abandonment at the well abandonment site.

FIG. 4 schematically depicts yet a further stage in the well abandonment at the well abandonment site 100. At this stage, part of the well 102 is filled with cement up to or substantially up to a desired cement level 136. As such, a cement plug is created between the cement level 136 and the seal plug 110.

The position of the cement level 136 may be verified in a verification step, for example by lowering a distance measurement device 138 into the well 102, which will land on top of the restriction member 124. For example, after the position of the cement level 136 has been determined, or at any other phase of the well abandonment, for example when it has been generally determined that sufficient cement is in the well 102, the restriction member 124 may be pulled out of the well, for example by crane 106.

At any stage when sealant or any other fluid or gas is supplied through the sealant conduit 120, the restriction member 124 may be lifted upwards, for example using the crane 106. The lifting speed of the restriction member 124 may approximately correspond to a speed with which a sealant level rises. A tension sensor may be used for determining a tension on the element from which the restriction member 124 is suspended, which may be the sealant conduit 120 or any other suspension element such as cable. A low tension may indicate that the restriction member 124 has to lifted upwards further.

Figure 5:
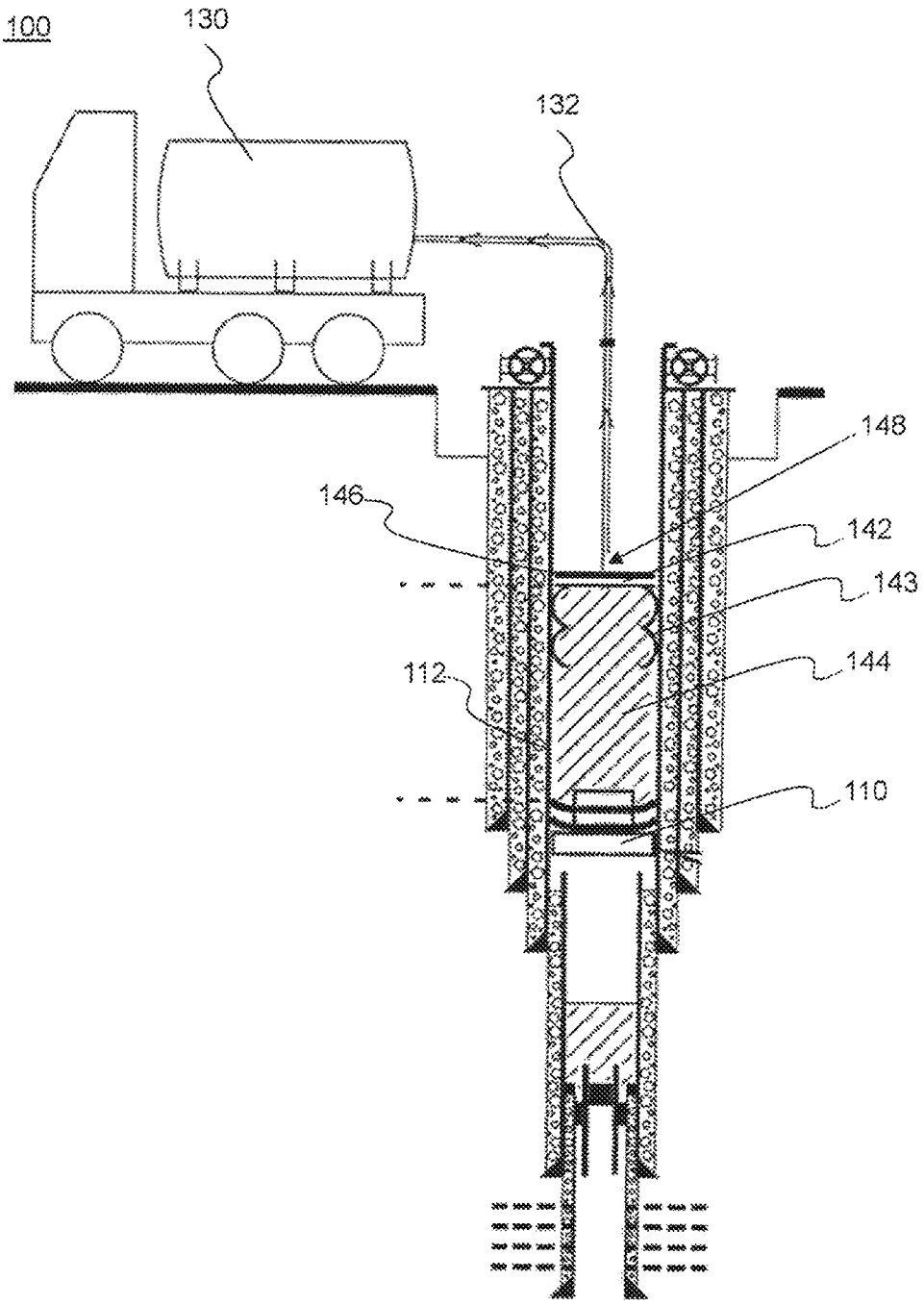
FIG. 5 schematically depicts an optional stage in the well abandonment at the well abandonment site.

FIG. 5 schematically depicts an optional stage in the well abandonment at the well abandonment site 100. In this stage, an optional tag plate 142 has been positioned on the cement plug 144. The tag plate 142 may comprise information indicative of the well 102, such as a date of abandonment, owner of the well, number of the well, any other information, or any combination thereof. The information may for example be visible on the plate 142. The information may be used by someone encountering the well 102 in the future.

Also, for example using the hose 132, substantially all fluid and/or other unwanted matter may be removed from the well 102.

The tag plate 142 may comprise one or more legs 143 or a skirt part protruding from the tag plate 142. The legs 143 may in an unrestricted state have an outer footprint such as an outer diameter which is larger than an inner diameter of the liner 112 or any other conduit in which the tag plate 142 is placed. The legs 143 may be elastically deformed into a restricted state. The tag plate 142 may be pushed into the liner 112.

FIG. 5 depicts an optional drain plate 146 which is connected to an upstream end of the hose 132. An upstream opening 148 is comprised by the hose 132 which allows fluid from being sucked up through the hose 132 at this upstream opening 148. The upstream opening 148 may be positioned near the drain plate 146. The drain plate 146 may be pushed downward into the well 102.

As further options, one or both of the drain plate 146 and the tag plate 142 may have one or more openings or through-holes. The hose 132 may extend through one or both of the drain plate 146 and the tag plate 142, and the upstream opening 148 of the hose 132 may be positioned below one or both of the drain plate 146 and the tag plate 142. As such, fluid may be sucked into the hose 132 from a position below one or both the drain plate 146 and the tag plate 142.

Figure 6:
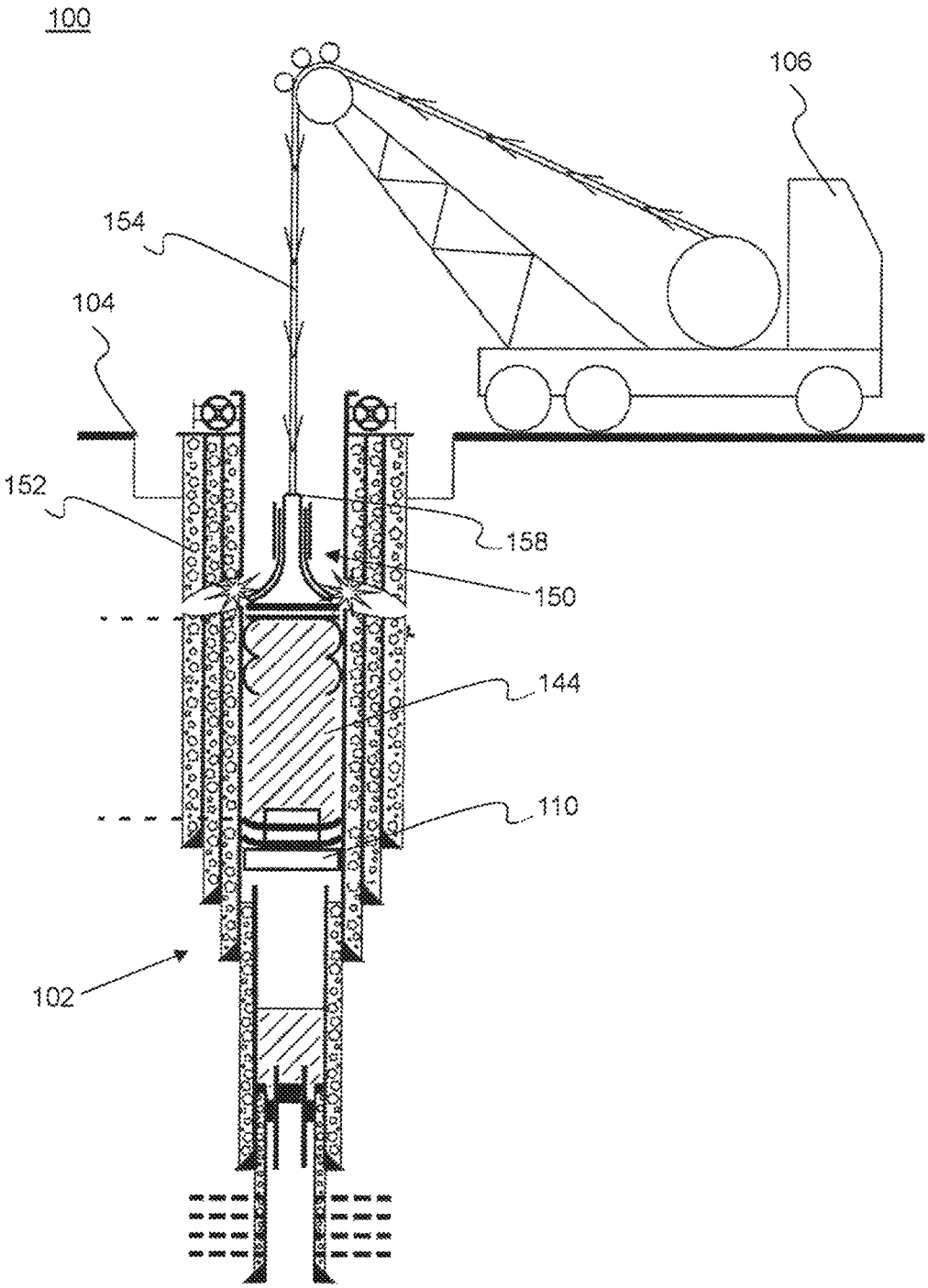
FIG. 6 schematically depicts the well abandonment site, at a further stage.

FIG. 6 schematically depicts the well abandonment site 100, at a further stage after the seal plug 110 and the cement plug 144 have been placed. It may be an object to remove part of the well 102, in particular an upper part 152 of one or more liners and/or casings which is closest to the ground surface 104. Instead of destroying the entire upper part 152, all liners and casings may be severed to release the upper part 152 from the remainder of the well 102 below the upper part 152.

FIG. 6 shows a device 150 for removing part of a liner or casing of a well or pile, which may be referred to as a liner removal device 150. An oxygen conduit 154 as an example of an oxygen supply or supply of oxygen is connected to the liner removal device 150. The liner removal device 150 is as an option suspended from the oxygen conduit 154, or may in other examples be suspended from a separate cable, rope, or any other suspension element. The removal device 150 may be suspended from a cable attachment point 158.

Figure 9:
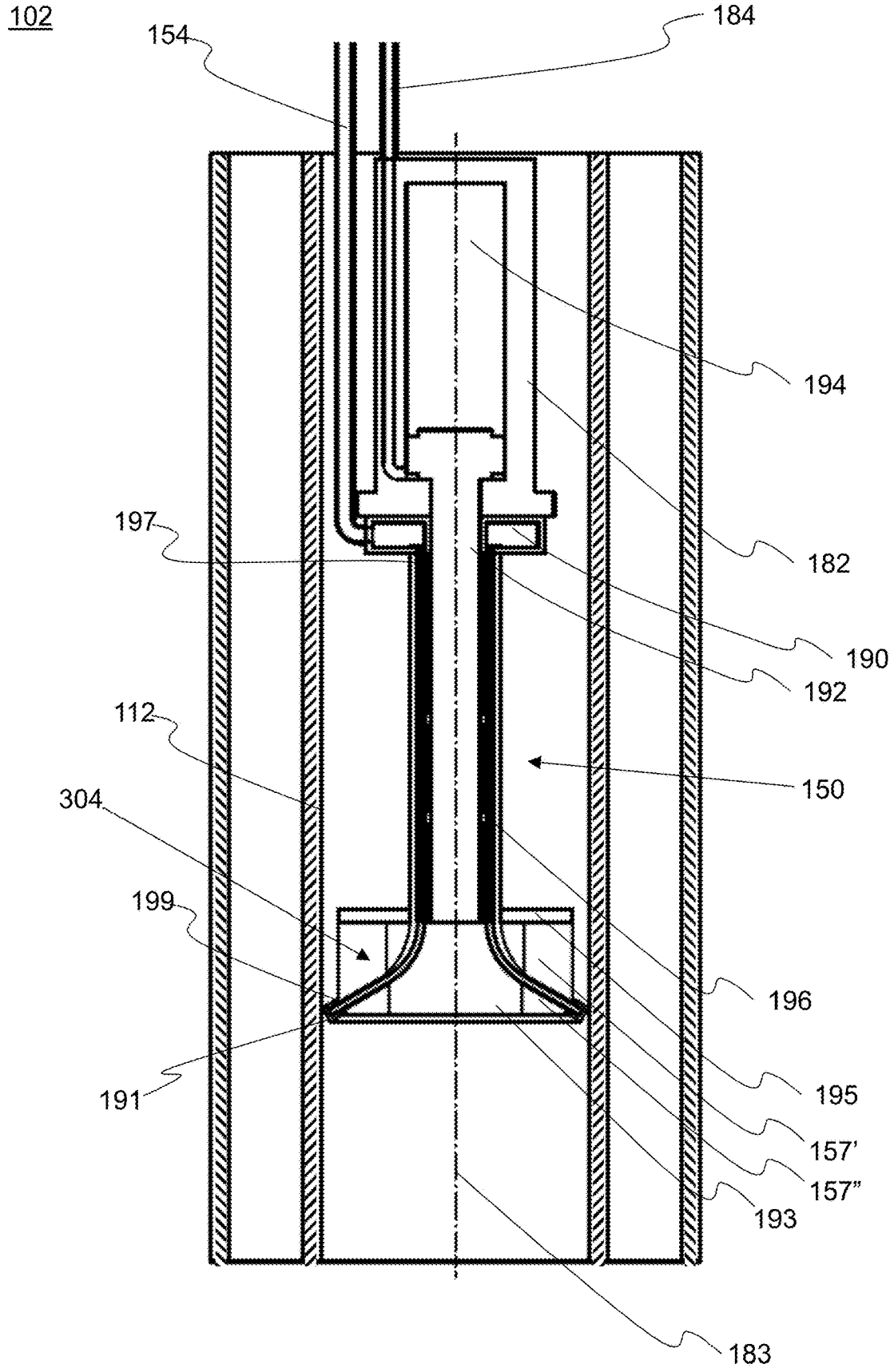
FIGS. 9, 10 and 11 show in more detail an example of a device for removing and/or severing part of a liner of a well.
Figure 10:
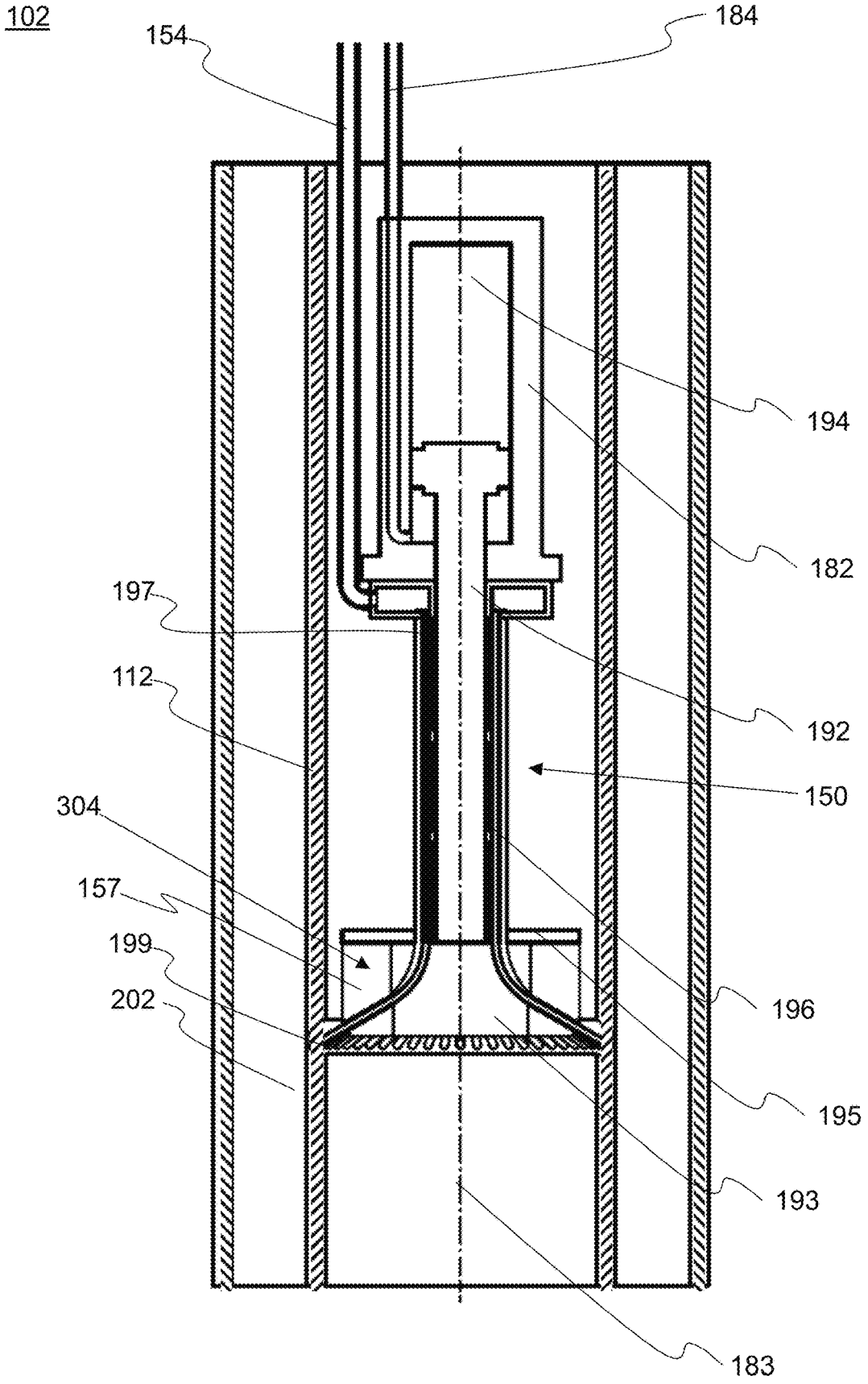
Figure 11:
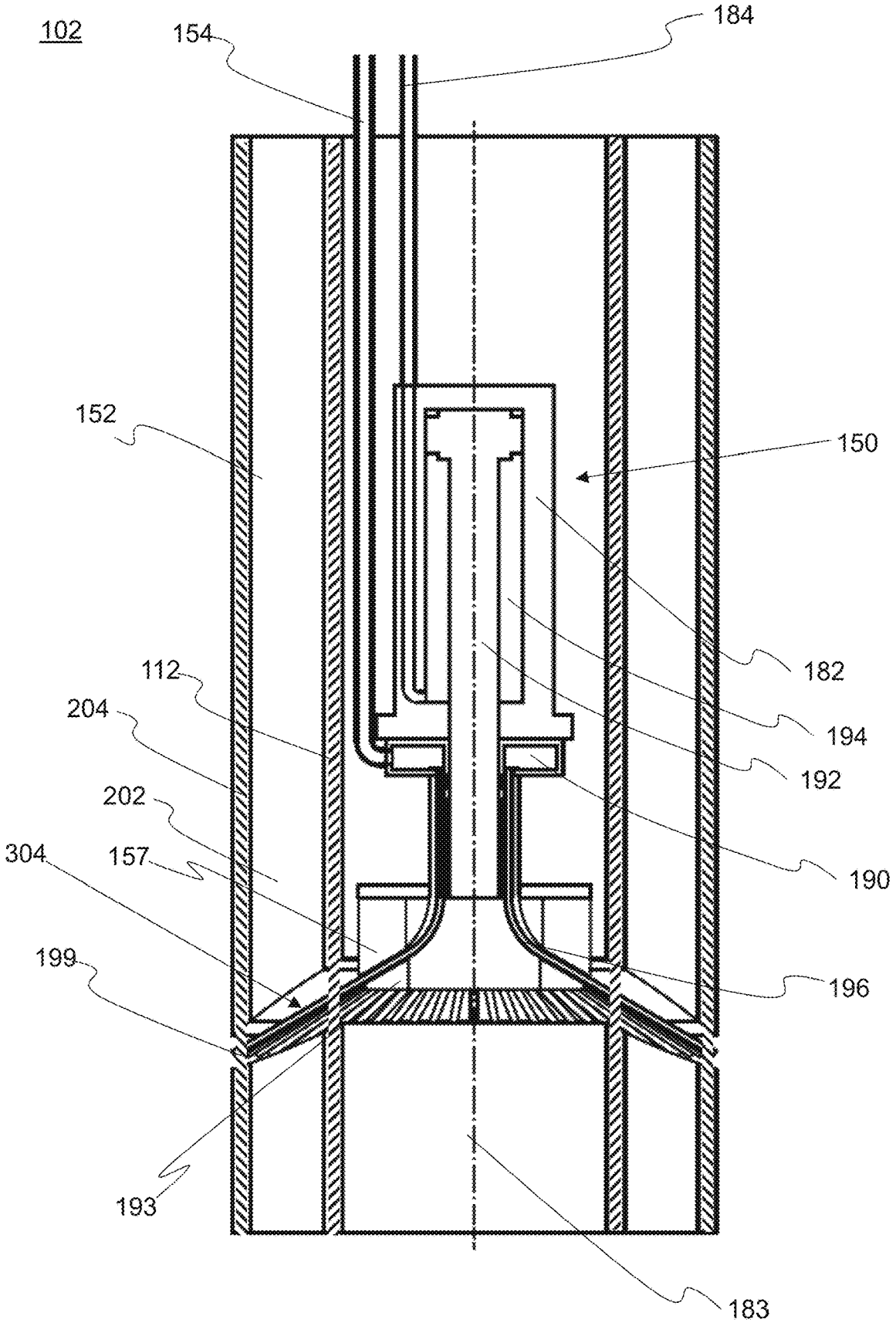

An embodiment of the liner removal device 150 is discussed in more detail in conjunction with FIGS. 9, 10 and 11. In will be understood that other embodiments of a liner removal device 150 or any other device for severing or removing a liner and/or casing may be used in the situation of FIG. 5 for separating the upper part 152 from the remainder of the well 102.

Figure 7:
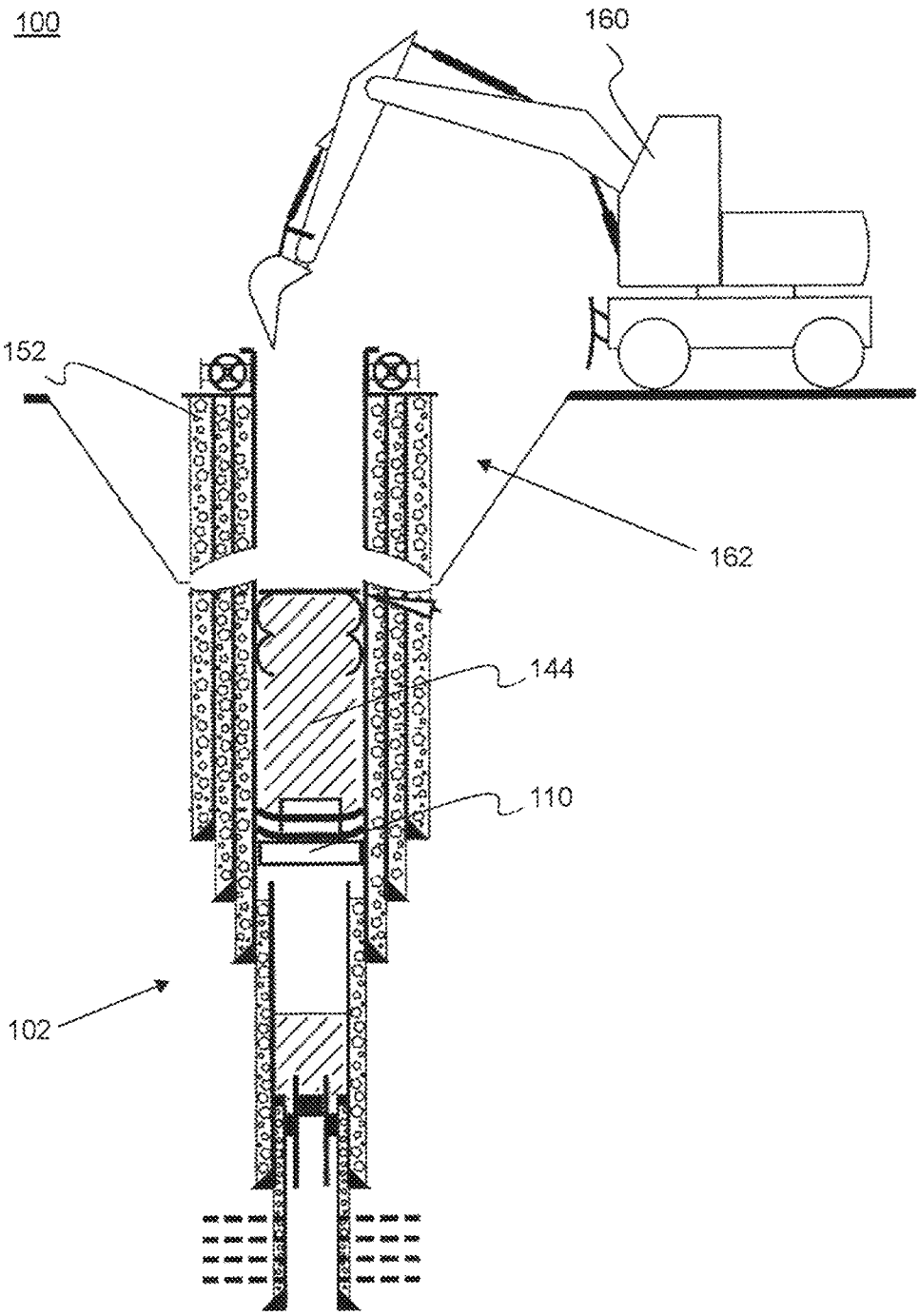
FIGS. 7 and 8 schematically depict the well abandonment site at different stages of the well abandonment.

FIG. 7 schematically depicts the well abandonment site 100, after the upper part 152 has been severed from the remainder of the well 102. The upper part 152 may now be removed from the ground. For example, ground surrounding the upper part 152 may be removed to create a hole 162 surrounding the upper part 152. When the ground surrounding the upper part 152 has been removed, the upper part 152 may be disposed of.

Figure 8:
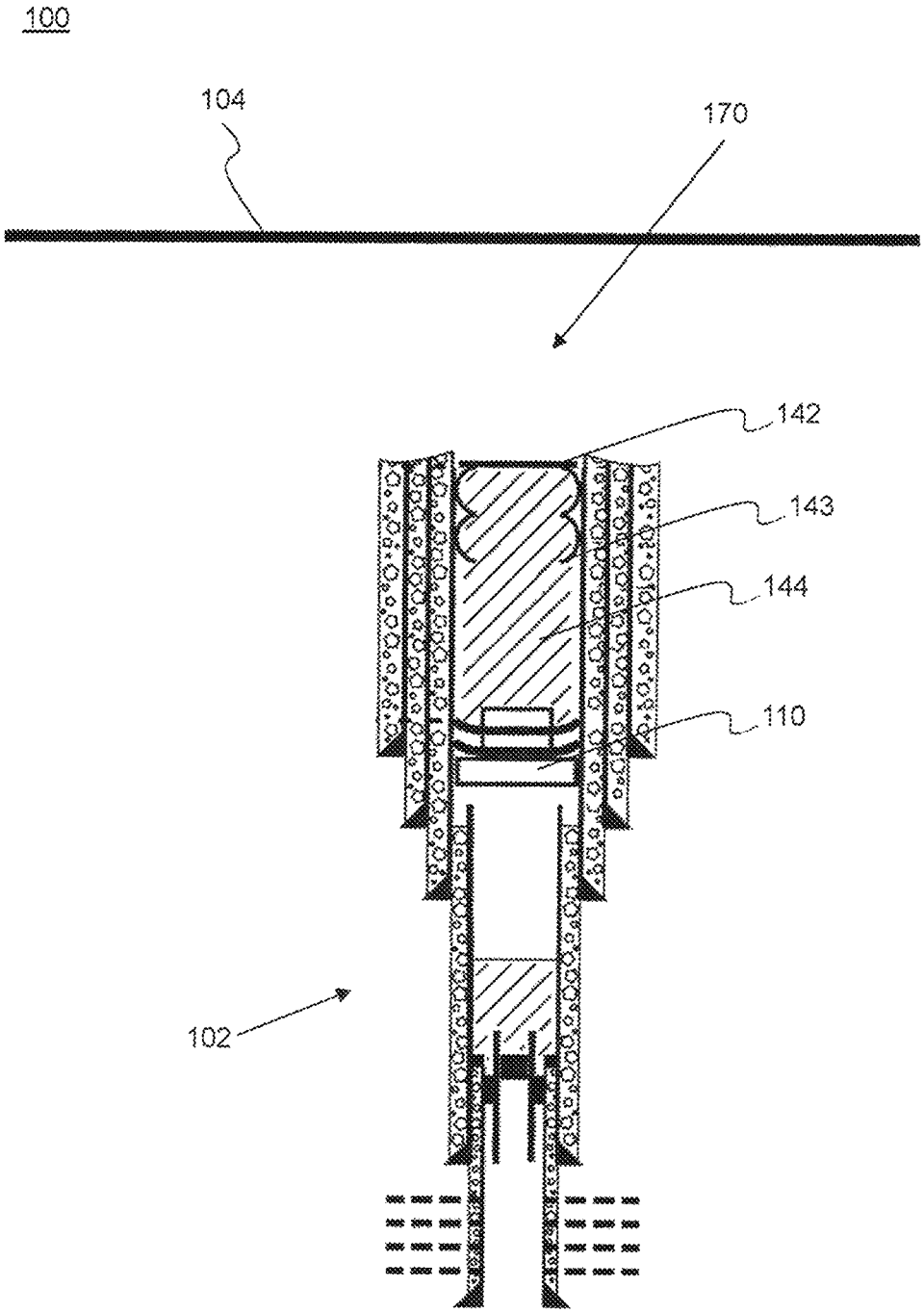

FIG. 8 schematically depicts the well abandonment site 100 at a finalised stage. Here, the remainder of the well 102 has been covered, for example with soil 170. On the soil 170, new activities may be started, such as agricultural activities or construction of buildings.

In general, and in particular in FIGS. 1-8, not all components may have been provided with reference numerals for clarity and conciseness of the figures. In general, similar components have the same visual appearance throughout the figures, in particular in FIGS. 1-8, and FIGS. 2A, 2B, 19 and 20, unless for example indicated otherwise.

FIGS. 9, 10 and 11 show in more detail an example of a device 150 for removing and/or severing part of a liner of a well or any other conduit, which may be referred to as a removal device 150. The device may for example be used at a stage in the well abandonment depicted in FIG. 6.

The liner removal device 150 comprises a housing 182 as a device body, which is arranged around a centreline 183 of the housing 182. The housing 182 may be at least partially or at least approximately fully rotationally symmetric around the centreline 183, or may in other embodiments be rotationally asymmetric around the centreline 183. The liner removal device 150 may be elongated in an elongation direction of the liner 112.

In use, as for example shown in FIG. 9, the centreline 183 of the housing 182 may be substantially parallel to a centreline of the liner 112. As such, when in this disclosure reference is made to a centreline 183 of the housing 182, as an option, this reference may correspond to the centreline of the liner 112.

As an option for an actuator of the feeding module, the liner removal device 150 of FIGS. 9 and 10 comprise a piston 192 and a cylinder 194 in which the piston 192 can translate. A hydraulic line 184 is provided for providing hydraulic fluid under pressure to an in use down side of the piston 192, for forcing the piston 192 to move relative to the cylinder 194.

In FIG. 9, an example of an ignition module 191 is depicted. The ignition module 191 is positioned near distal ends 199 of the pipes of the bundle of pipe 196.

FIG. 9 depicts two restriction members 157' and 157" which are positioned opposite to each other. Between the restriction members 157' and 157", a passage for pipes is provided. The passage may be sufficiently narrow to only allow passage of pipes which are positioned substantially next to each other, instead of on top of each other. As such, pipes when fed in a direction away from the centreline 183 may be forced into the particular arrangement shown in FIGS. 14A and 14B.

In the particular embodiment of FIGS. 9, 10 and 11, the piston 192 is pressed up into the cylinder 194 and, e.g. simultaneously, the liner removal device 150 is lowered further into the well 102 for example at approximately the same pace. As such, a level of distal ends of the hollow conduits may remain substantially the same, e.g. defining a cutting or severing plane.

The piston 192 may be directly or indirectly connected to the liner 112, such that the axial position of the piston 192 is fixed in the liner 121. For example, one or more connection members such as strips, cables, or any connection member which for example may withstand a tension force, may be positioned around the bundle of pipes 196. The piston 192 may for example even be suspended from the well at or near the well head, in particular at an uppermost part of the well at or near the ground surface.

To accommodate this particular suspension arrangement, part of the piston 192 may be exposed—i.e. not fully surrounded by other components of the removal device 150. Alternatively to lowering the liner removal device 150 into the well 102, the liner removal device 150 in particular the piston may be connected to the liner 112 or any other part of the well 102. For example, a radial clamping mechanism may be used for engaging an inner wall of the liner 112 and with that connecting the liner removal device 150 to the well 102. The cylinder 194 may then be used to push proximal ends of the hollow conduits downward to move distal ends of the hollow conduits towards the inner wall of the liner 112, for example over an outer surface of the wedge 193. The cylinder 194, piston 192, and wedge 193 may together form a feeding module, or may more in general be comprised by a feeding module.

The liner removal device 150 comprises as an example of hollow conduits a bundle of pipes 196 which are disposed around the centreline 183. An oxygen supply chamber 190 is positioned near a proximal end 197 of the bundle of pipes 196. Distal ends 199 of the pipes 196 are positioned near an inner wall of the liner 112, at an angle relative to the centreline 183. The oxygen supply conduit 154 may be connected to the oxygen supply chamber 190, from where it may be distributed to the proximal ends 197 of the pipes 196. Since the pipes 196 are hollow conduits, oxygen may flow through the pipes to their distal ends 199.

FIG. 10 depicts a situation wherein part of the liner 112 has been removed. Surrounding the liner 112 is a layer of annulus casing 202, which casing 202 may for example comprise cement which may also be removed by the removal device. In FIG. 11, a situation is depicted wherein part of this layer or casing 202 as well as an outer liner 204 has been removed—severing an upper section 152 from a remainder of the well 102.

In general, an annulus casing 202 may be at least partially filled with any matter, solid, liquid, gaseous, cement, or any combination thereof. As such, part of the annulus casing 202 may be filled with air.

In FIG. 10, an optional restriction member 195 is indicated, which is arranged for defining a position of one or more pipes 196, for example above a distal end section 304 of the pipes 196. The restriction member 195 may be positioned above the wedge 193.

Although in FIGS. 9-11 a bundle of pipes is shown as an example of one or more hollow conduits, many different arrangements and embodiments of hollow conduits are envisioned. Some of the envisioned arrangements and embodiments of the one or more hollow conduits are elaborated on in conjunction with FIGS. 12A-15D. In these figures, components of the removal device may have been omitted for clarity and conciseness of the figures.

FIGS. 12A-12D schematically show a top view and a cross-sectional view of a liner or casing 112 with one or more hollow conduits positioned in the liner or casing 112. In general, arrows in the FIGS. 12A-15D indicate a direction of movement of a hollow conduit, for example away from a centreline 183 of a device body—i.e. towards an inner wall 210 of the liner 112 or parallel to the centreline 183. In general, any option disclosed in conjunction with a pipe 214 may be readily applied to other embodiments of hollow conduits, and thus to any embodiment of the removal device 150.

Figure 12A:
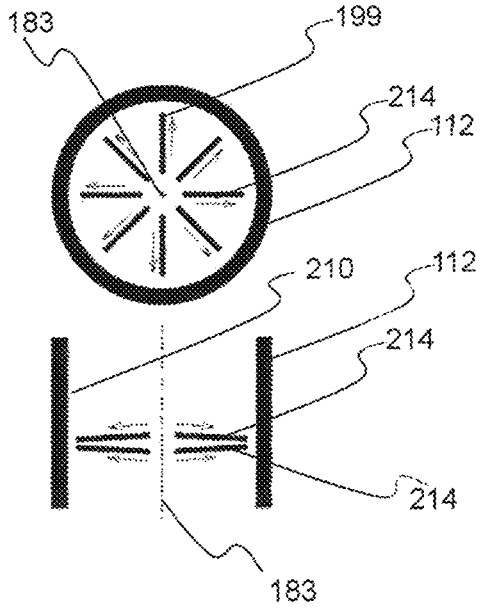
FIGS. 12A-12D schematically show a top view and a cross-sectional view of a liner or casing with one or more hollow conduits positioned in the liner or casing.

FIG. 12A shows a first embodiment. In the top view, eight pipes 214 as an example of a number of pipes are visible. The arrows adjacent the pipes 214 indicates a direction away from centreline 183, towards the inner wall 210. The cross-section views an option wherein multiple pipes 214 are stacked on top of each other, and converge towards the inner wall 210. In particular, two or more pipes 214 may converge towards a single point, which single point may for example lie inside the liner 112 within the hollow conduit defined by the liner, in the liner material itself or outside the liner 112.

Figure 12B:
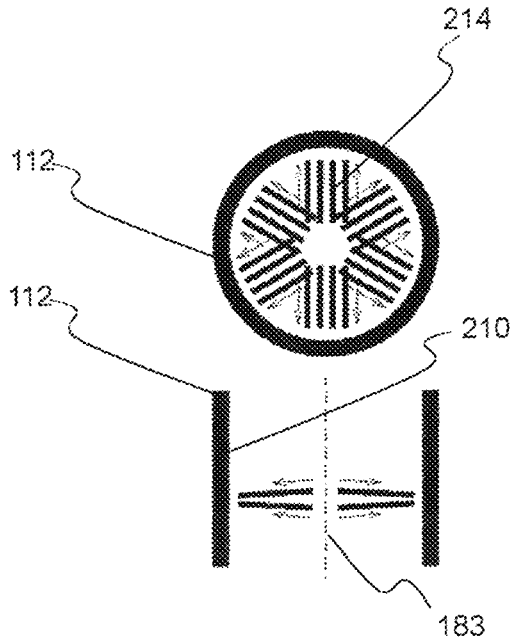

The top view of FIG. 12B depicts an option were multiple pipes 214 as hollow conduits are positioned parallel to each other. Multiple groups of parallel pipes 214 are disposed around the centreline 183, for example at equal angular intervals. A group of parallel pipes 214 may for example comprise 2, 3, 4, 5 or even 6 or more pipes.

As an option, multiple pipes 214 or even all hollow conduits may be fed away from the centreline 183, towards an imaginary circle or any other polygon depending on the arrangement of the hollow conduits. This circle may lie outside the conduit, liner or casing which is to be severed. At or near this circle, distal ends of the hollow conduits may contact or intersect.

Figure 14A:
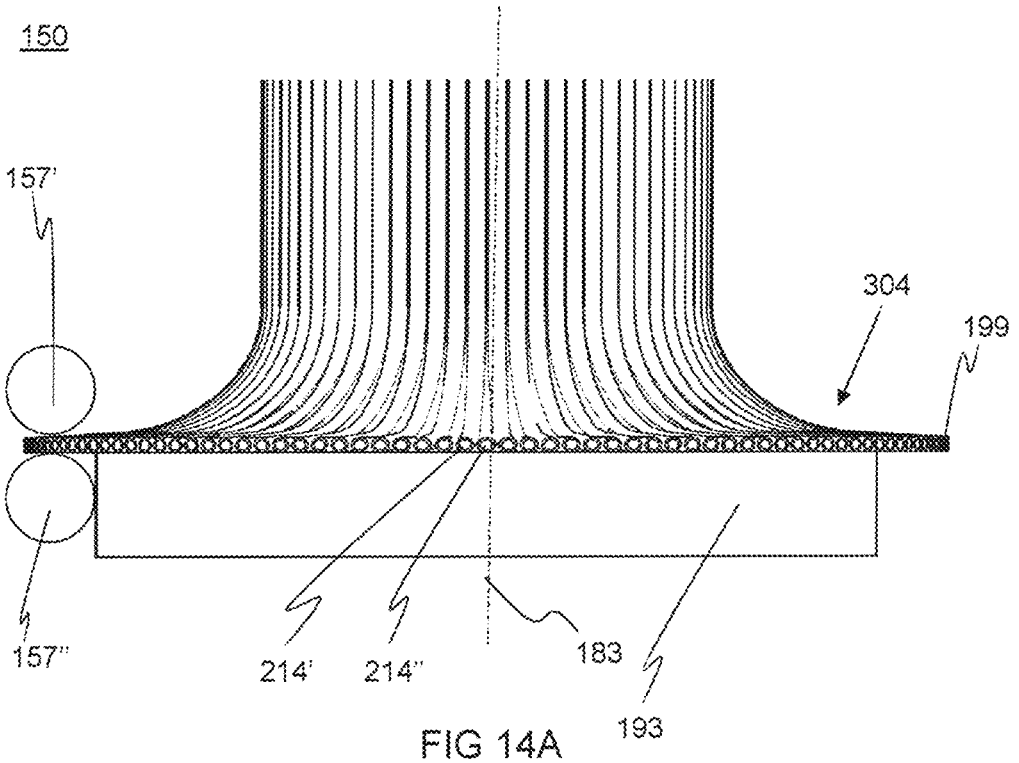
FIG. 14A shows a schematic side view of part of a removal device.
Figure 14B:
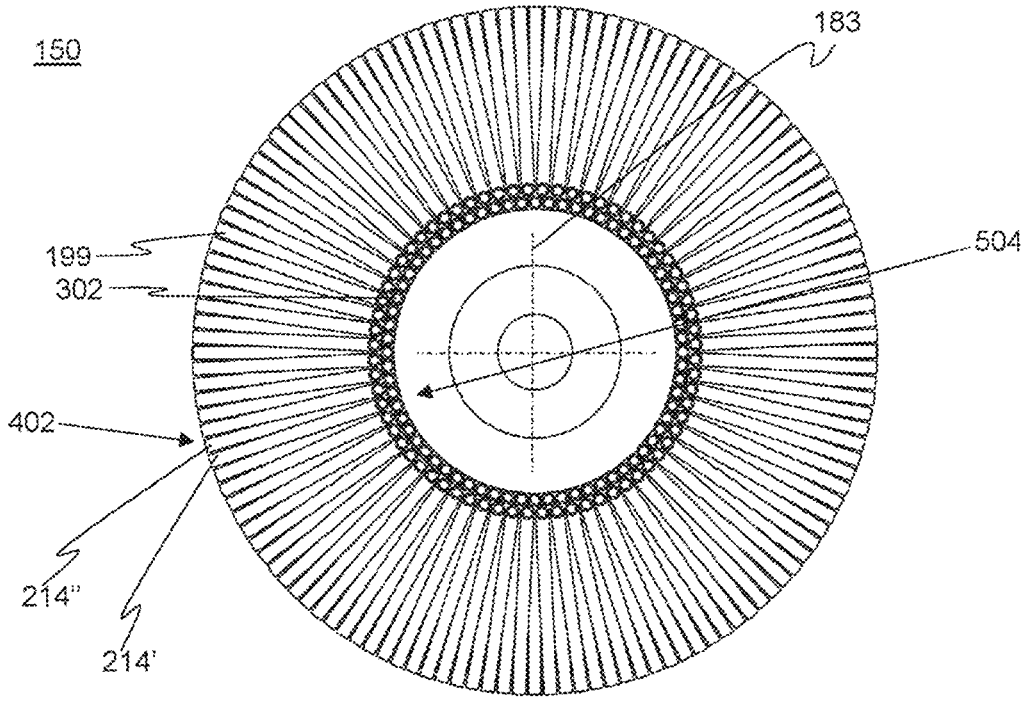
FIG. 14B shows a schematic top view of part of a removal device.

In general, when the removal device 150 comprises more than one hollow conduit, when regarded in a radially outward direction, away from centreline 183, a tangential distance between distal ends of adjacent hollow conduits increases. As such, in a radially inward direction, towards centreline 183, the tangential distance between the adjacent hollow conduits decreases, even to a distance smaller than an outer diameter or footprint of the hollow conduits. To accommodate this smaller distance, adjacent hollow conduits may be stacked one over the other in a direction parallel to centreline 183. The first pipe 124' and the second pipe 124" of FIGS. 14A and 14B are examples of adjacent hollow conduits.

As an even further option, hollow conduits may be fed from both axial directions. In the figures, proximal ends of the hollow conduits are fed in a direction axially downward. Embodiments of removal device are envisioned wherein one or more hollow conduits are fed in a direction axially upward, or where some hollow conduits are fed in an axially downstream direction and other hollow conduits are fed in an axially upstream direction.

Figure 12C:
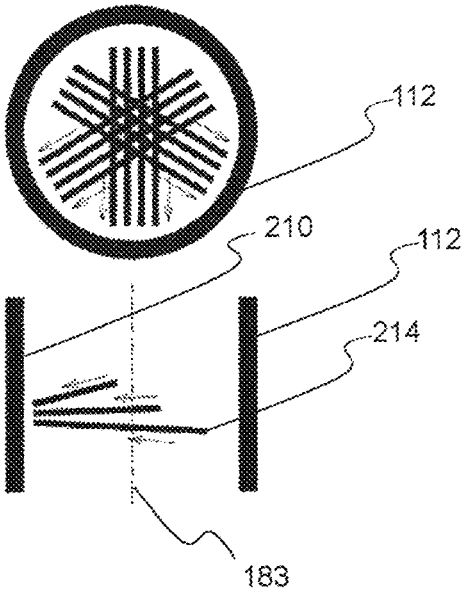

While in the examples of FIGS. 12A and 12B the pipes in a radial direction may be smaller than a radius of the inner wall 210 of the liner 112, FIG. 12C depicts in the top view an option wherein in the radial direction, one or more pipes 214 or other hollow conduits may be longer than the radius of the inner wall 210 of the liner 112. The cross-sectional view of FIG. 12C depicts an option wherein three pipes 214 are oriented substantially non-parallel converging towards the inner wall 210, for example approximately towards a single point of convergence. In a top plan view, the pipes 214 may at least partially overlap.

Figure 12D:
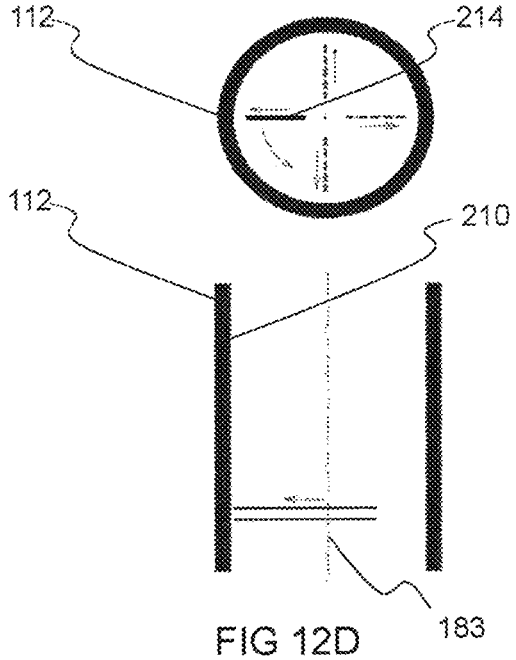

FIG. 12D depicts an option wherein one or more pipes 214 are rotated in a direction parallel to the centreline 183, and as a further option simultaneously are moved towards the inner wall 210 of the liner 112.

In FIGS. 12A-12D, in particular only distal end sections of hollow conduits may have been depicted. Proximal end sections may be oriented differently or substantially the same as distal end sections of hollow conduits. For example, when the distal end section of a pipe 214 is in a radial direction shorter than a radius of the inner wall 210 of the liner 112, a proximal end section of the pipe 214 may be oriented parallel to the centreline 183, or at least partially oriented towards the centreline 183.

It will be understood that FIGS. 12A-15D show merely some of the embodiments envisioned. Options disclosed in conjunction with one figure or even one top view or cross-sectional view may be readily combined into other embodiments.

Figure 13A:
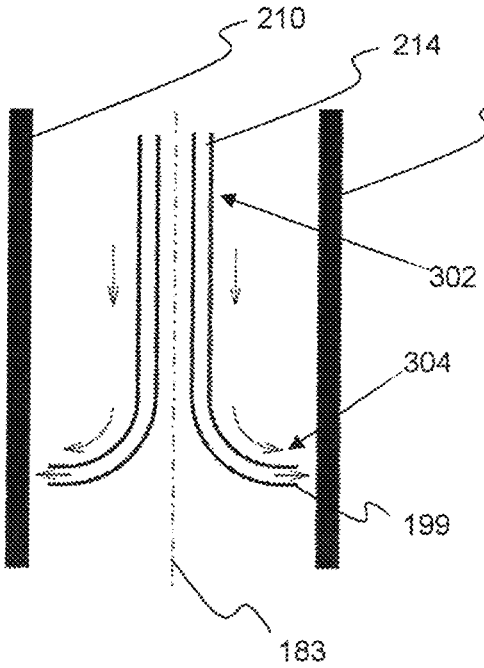
FIGS. 13A and 13B show a schematic cross-sectional view of a liner and pipes as hollow conduits.
Figure 13B:
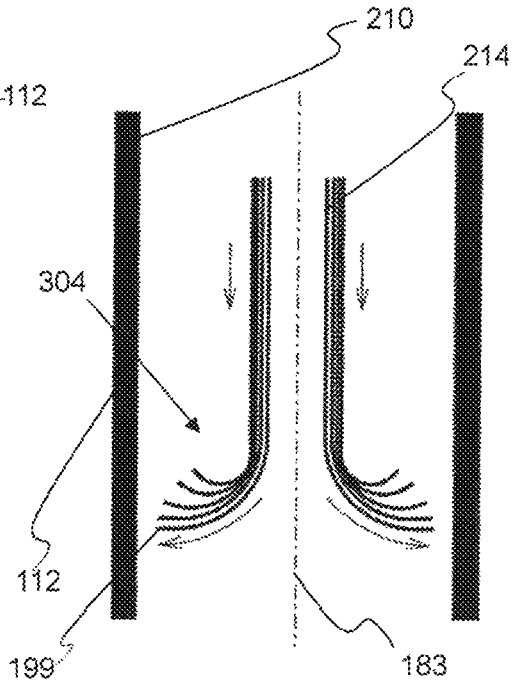

FIGS. 13A and 13B show a schematic cross-sectional view of a liner 210 with pipes 214 as hollow conduits. A proximal end section 302 of a pipe 214 is indicated in FIG. 13A, which as an option may be oriented substantially parallel to the centreline 183 or for example at least in an upward direction, in use. A distal end section 304 of the pipe 214 is oriented towards the inner wall 210 of the liner 112.

FIG. 13B depicts in a schematic cross-sectional view an option wherein distal end sections 304 and even distal ends 199 of different pipes 214 are oriented at different angles relative to the centreline 183, which centreline 183 may be a centreline of a removal device and/or the liner 210.

Figure 13C:
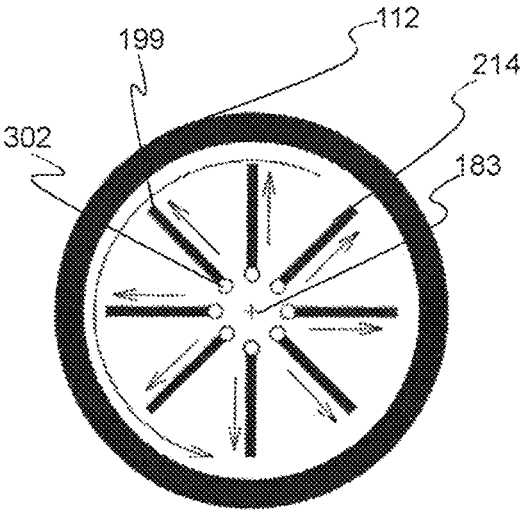
FIGS. 13C and 13D show in a top view further options for arrangements of pipes.

FIG. 13C shows yet another option for an arrangement of pipes 214 showing that proximal end section 302 may be disposed on a circle. In the yet even further option of FIG. 13D, two sets of pipes 214 are shown, of which a first pipe 214' has its proximal end section 302 on a circle with a larger diameter than a second pipe 214". Pipes 214 may be positioned on two or more circles. This may allow a more compact design of the hollow conduits, and/or distal ends of hollow conduits may be positioned at a higher density near the inner wall 210 of the liner.

Figure 13D:
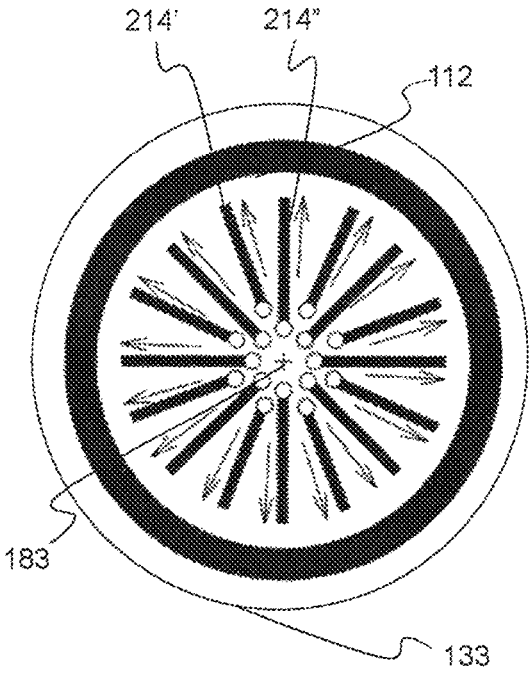

When hollow conduits such as pipes 214 are disposed on more than one circle, such as for example shown in FIG. 13D, distal ends of the hollow conduits corresponding to any circle may be pointed towards another circle, which circle may be outside the liner 112, or any other further liner, casing or conduit of which material has to be removed. An example of a circle outside the liner 112 is shown by dotted circle 133 in FIG. 13D.

FIG. 14A shows a schematic side view of part of a removal device 150, comprising the first pipe 214' and the second pipe 214" of FIG. 13D. Pipes such as the first pipe 214' which are disposed on an outer circle may be pushed over the pipes such as the second pipe 214" disposed on an inner circle. The second pipe 214" may be pushed over the wedge 193 to orient the distal end of the second pipe 214" away from the centreline 183.

To prevent pipes from curling up after being pushed over the wedge 193, any number of orientation members 157 may be comprised by the removal device 150. An orientation member 157 may be used to reorient the distal end or distal end section of a pipe, and is for example shown in FIG. 10 and FIG. 14A. After passing the orientation member 157, the distal end section may be a substantially straight distal end section. The orientation member 157 may for example provide an outer surface against which the pipe may slide, or may for example comprise one or more rollers past which the pipe may pass. The orientation members are also depicted for example in FIG. 11, where an orientation member 157 is positioned at an opposite side of a pipe than the wedge 193.

FIG. 14B shows a schematic top plan view of part of the removal device 150 of FIG. 14A. As shown in FIG. 14B, part of the first pipe 214' overlaps the second pipe 214". In particular, as an option, only at a distal end 402 of the pipes, the first pipe 214' does not overlap the second pipe 214". At this distal end 402, a tangential distance between the first pipe 214' and the adjacent second pipe 214" is larger than an outer diameter of the first pipe 214'. As such, the distal ends of the first pipe 214' and the second pipe 214" may be positioned in substantially the same radial plane. At their proximal ends 504, a tangential distance between the first pipe 214' and the second pipe 214" is smaller than an outer diameter or footprint of the first pipe 214'.

At least from the examples depicted in FIGS. 12A, 12B, 13C, 13D, 14B, it becomes apparent that as an option, distal ends 199 of one or more pipes 214 may be generally disposed on a circle. This may allow the distal ends 199 to be generally positioned at a particular distance or within a particular range of distances relative to an inner wall of a liner, in particular when the liner has a generally circular cross-sectional shape.

A distal end 199 may in general be defined as an outer end of a distal end section 304. A distal end section 304 may have a particular length, for example corresponding to 20% or less, 10% or less, 5% or less, or even 1% or less of the total length of a hollow conduit.

Figure 15A:
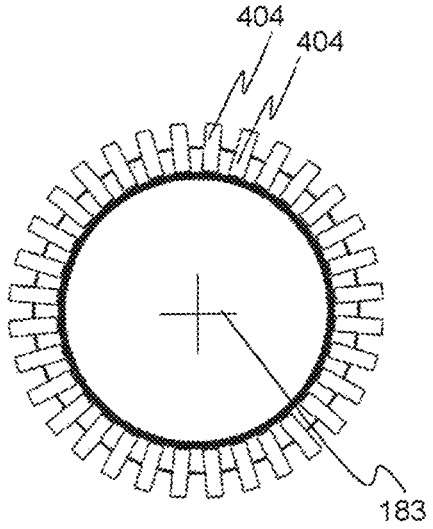
FIGS. 15A and 15B show different schematic views of an option wherein the one or more hollow conduits are formed by multiple hollow conduits.
Figure 15B:
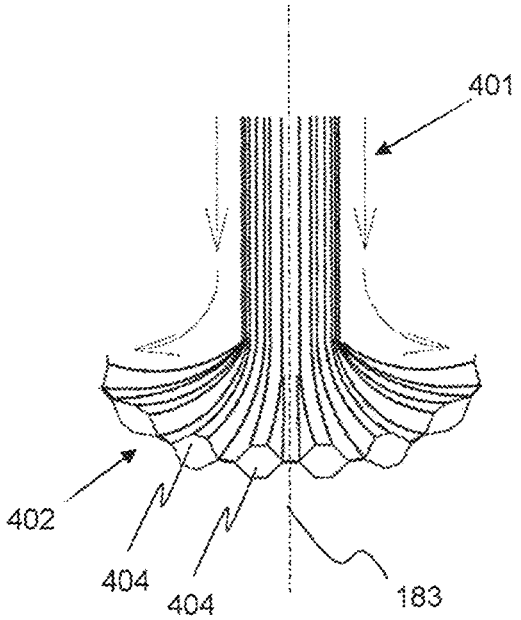

FIGS. 15A and 15B show different schematic views of an option wherein the one or more hollow conduits are formed by multiple hollow conduits 404 which are connected to each other. In particular, FIG. 15A shows a top view and FIG. 15B shows a perspective view. The connected hollow conduits 404 may be interconnected in a substantially tangential direction relative to the centreline 183. The flow direction at the proximal end 401 may be generally axial, whereas the flow direction at the distal end 402 may be generally radially. When the hollow conduits 404 are connected in a generally tangential direction, the conduits 404 are connected in a direction substantially perpendicular to a flow direction for oxygen through the hollow conduits.

FIG. 15B shows that as an option, at a proximal end 401, the hollow conduits 404 may be oriented differently that at a distal end 402. In particular, the hollow conduits 404 may taper outward, for example away from the centreline 183. To allow this tapering shape, the cross-sectional shape of the hollow conduits 404 may change, as will be elaborated on in conjunction with FIGS. 15C and 15D.

Figure 15C:
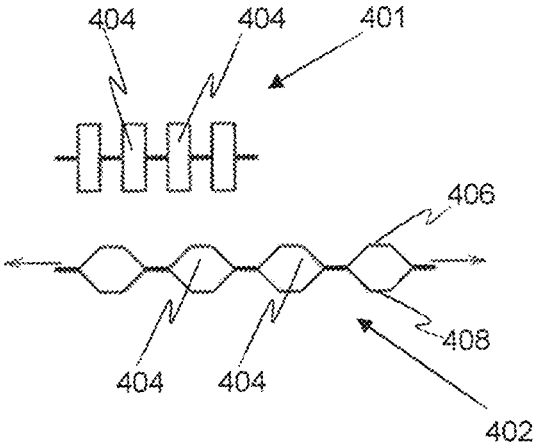
FIGS. 15C and 15D schematically show different options for a cross-sectional shape of hollow conduits at a proximal end, and a distal end.
Figure 15D:
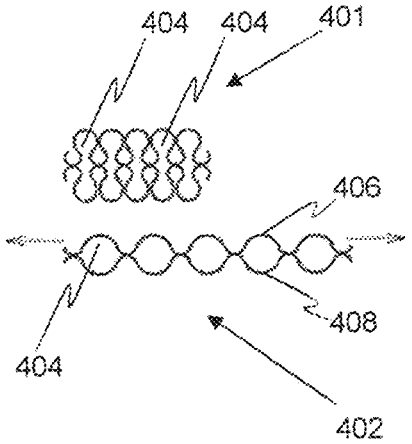

FIGS. 15C and 15D schematically show different options for a cross-sectional shape of hollow conduits at a proximal end 401, and a distal end 402. As shown, the cross-section shape may differ between the proximal end 401 and the distal end 402. The arrows in FIGS. 15C and 15D indicate a direction in which the hollow conduits may be stretched to allow the tapering shape shown in FIG. 15B. The hollow conduits of FIGS. 15C and 15D may for example be formed by a first curved sheet 406 connected to a second curved sheet 408.

Although the removal device is in the figures depicted as being used in a substantially vertical well for removing a substantially vertically oriented liner or casing, embodiments of the removal device may also be used in non-vertically oriented conduits, liners or casings. For example, the removal device may be pushed, lowered, and/or pulled into a horizontally oriented liner or casing, or a liner or casing in any orientation between vertical and horizontal.

Figure 16A:
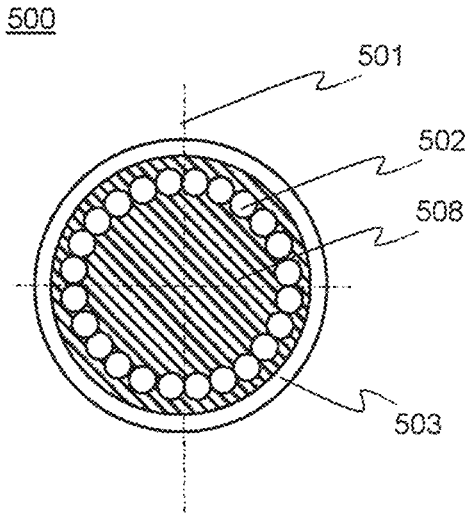
FIGS. 16A-16D schematically depict examples of arrangement of hollow conduits.
Figure 16B:
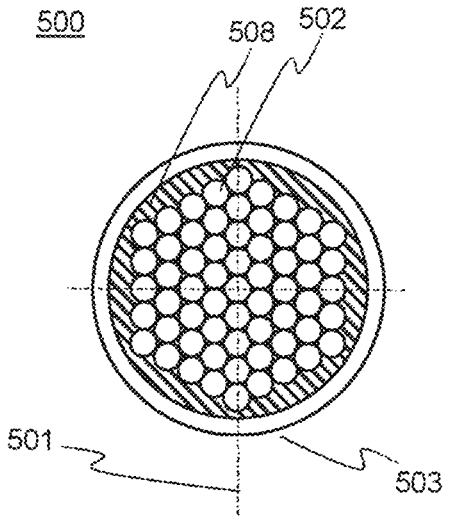
Figure 16C:
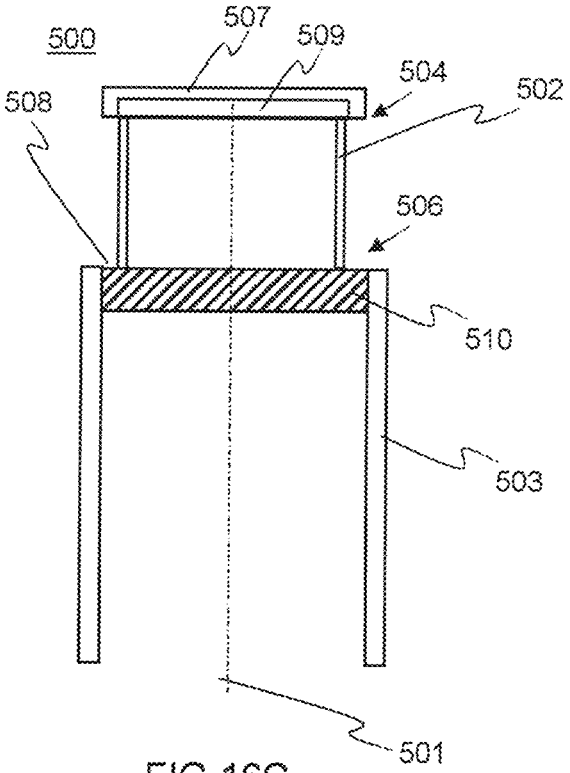
Figure 16D:
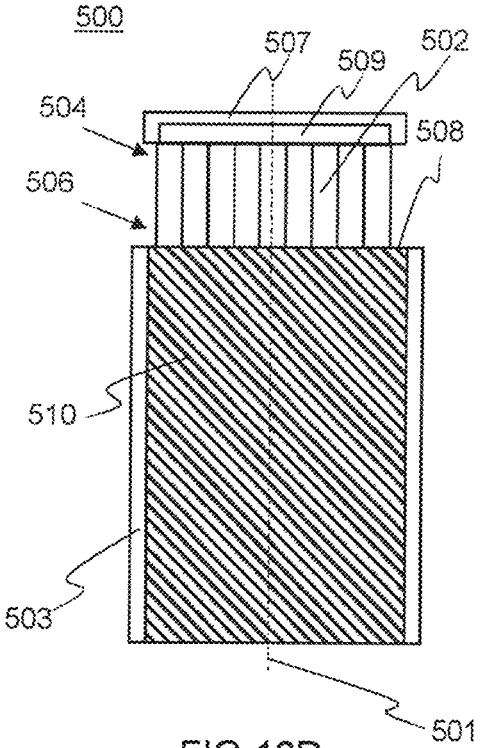

FIGS. 16A-16D show an embodiment of an axial material removal device 500 for removing part of an element 510, comprising one or more hollow conduits 502. FIGS. 16A and 16B depict a top view, and FIGS. 16C and 16D depict a cross-sectional view. The device 500 is positioned on top of a surface 508 of an element 510 of which part is to be removed. In use, the surface 508 may for example be a substantially horizontal surface.

The element 510, shown hatched in FIGS. 16A-17B, may for example be a cap on a conduit 503, a plug inside a conduit, or any other solid matter. The element 510 may comprise any material, such as steel, cement, sealant, any metal, any plastic, stone, rock, granite, any other material, or any combination thereof.

At their proximal end 504, the hollow conduits 502 are arranged to receive a flow of oxygen from any supply of oxygen. Through a hollow conduit 502, oxygen can be transported to a distal end 506. When the hollow conduits 502 are ignited at their distal end 506, the combustion may generate heat with which material may be removed.

FIGS. 16A-16D schematically depict examples of arrangement of hollow conduits 502 comprised by the device 500. In FIGS. 16A and 16C, the hollow conduits 502 are disposed in a circle around a centreline 501. Instead of in a circle, hollow conduits 502 may be positioned in any other form, such as a square, rectangle, or on a perimeter of any polygon.

Figure 17A:
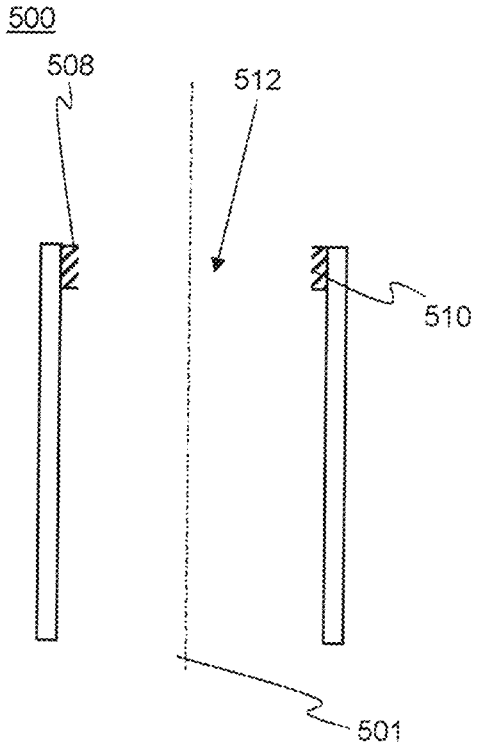
FIGS. 17A and 17B show different results of the removal of part of an element.

FIG. 17A shows the result of the removal of part of the element 510. In particular, an opening 512 has been created through the element 510. The shape of the opening 512 may correspond to the polygon-shape in which the hollow conduits were disposed, for example a circle.

In the example of FIGS. 16B and 16D, a plurality of hollow conduits 502 are bundled together into a bundle. One or more of the hollow conduits 502 may be in contact with each other, and/or one or more of the hollow conduits 502 may be spaced apart without contacting adjacent hollow conduits.

Figure 17B:
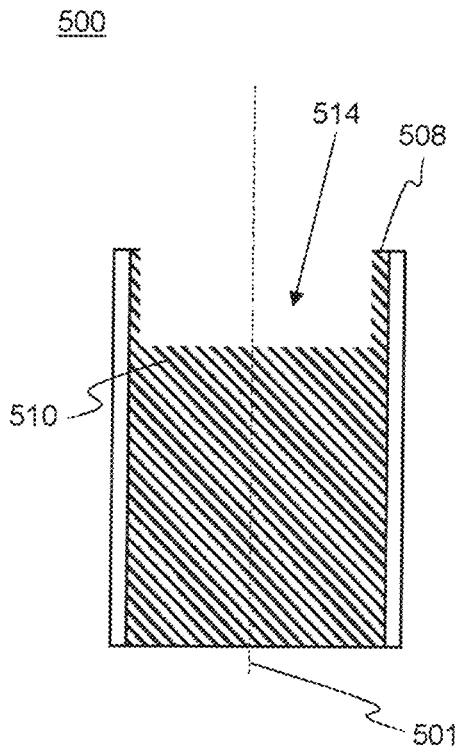

FIG. 17B shows the result of the removal of part of the element 510. In particular, a pocket 514 has been created. The shape of the pocket may correspond to a shape which was filled by the bundle of hollow conduits 502, for example depicted in FIG. 16B. The depth of the pocket in a direction parallel to the centreline 501 may be controlled for example by a time of combustion and/or a length of the hollow conduits 502 that is combusted.

The one or more hollow conduits 502 may be positioned relative to each other by a frame 507. In particular, the hollow conduits 502 may be connected to the frame 507 at or near their proximal ends 504. The frame 507 may comprise an oxygen distribution chamber 509 through which oxygen may be supplied to proximal ends 504 of the hollow conduits 502. Any ignition module may be used for igniting distal ends of the hollow conduits 502.

Figure 18A:
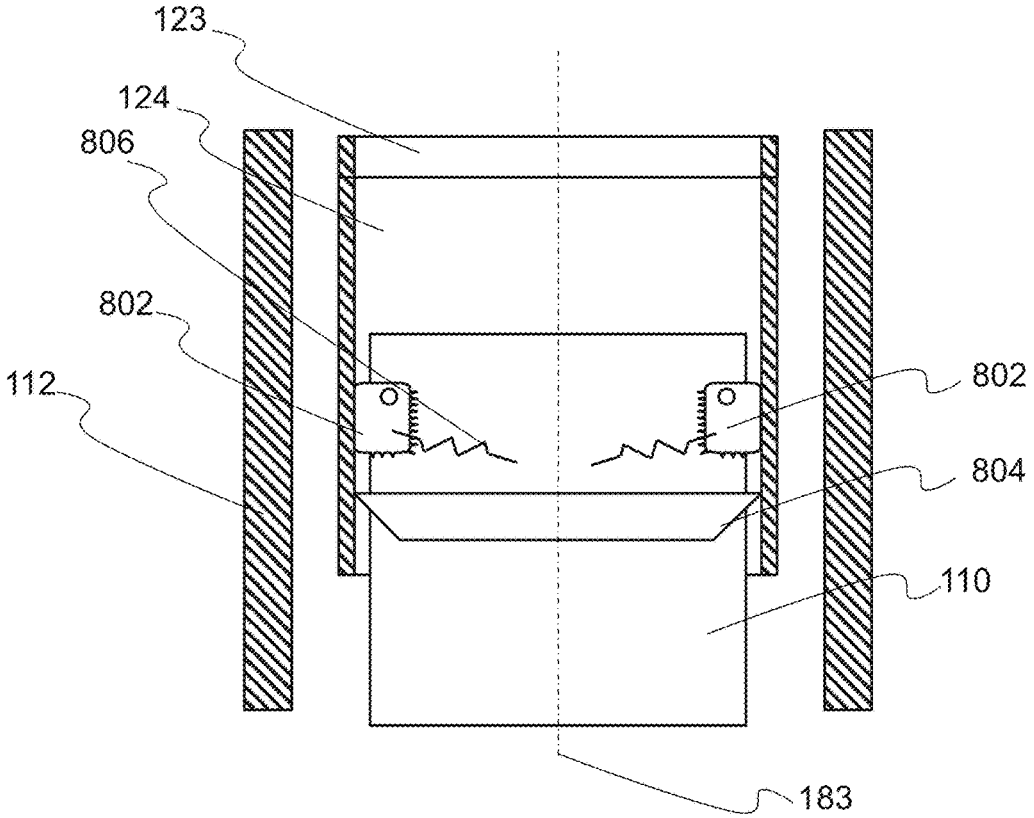
FIGS. 18A and 18B schematically depict an option for a seal plug.
Figure 18B:
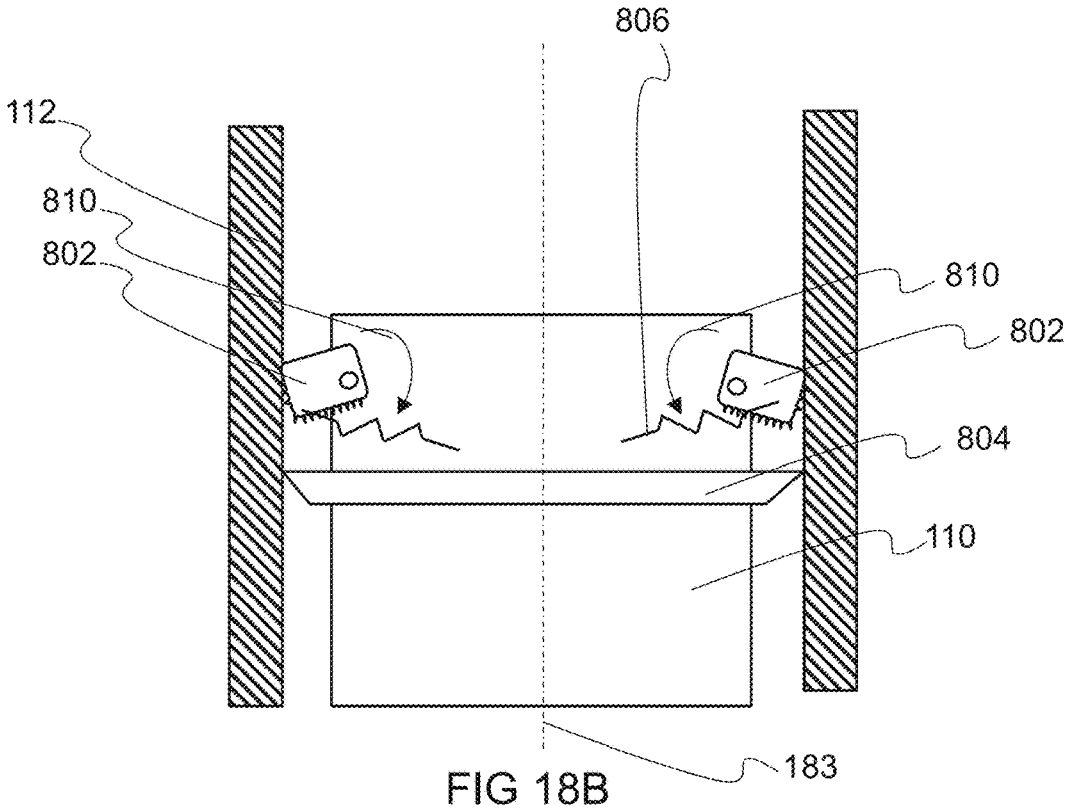

FIGS. 18A and 18B schematically depict an option for a seal plug 110, in particular depicting two clamping members 802. In particular, FIG. 18A depicts the clamping members 802 in a restricted state—i.e., restricted by the restriction member 124. FIG. 18B depicts the clamping member 802 in an unrestricted state—i.e. not restricted by the restriction member 124.

The seal plug 110 further comprises a circumferential sealing member 804, which for example may be an elastic or resilient ring. The sealing member 804 is in FIG. 18A elastically deformed in a restricted state, and in FIG. 18B in an unrestricted state—i.e. not restricted by the restriction member. In the state of FIG. 18B, the sealing member 804 may restrict of block flow of fluid past the seal plug 110.

The clamping members 802 of FIGS. 18A and 18B are provided with a spring 806 as a biasing member. The spring 806 may for example be a torsion spring or a compression spring. The spring 806 applies a force to the biasing member for rotating the biasing member, which rotating is depicted by the curved arrows 810 in FIG. 18B.

In the restricted state of FIG. 18A, a low friction surface of the clamping members 802 contacts the restriction member. In the unrestricted clamping state of FIG. 18B, a different high friction surface of the clamping members 802 contacts the liner 112, in particular an inner wall of the liner. As such, it may be prevented that the seal plug 110 becomes stuck in the restriction member 124, while also being able to provide sufficient clamping force for the seal plug 110 to the liner 112.

A low friction or high friction surface may be obtained by a material of the surface, by a coefficient of the friction of said surface, by one or more protrusions protruding from a surface, such as sharp protrusions, or any combination thereof.

As the clamping members 802 are rotated further in the rotation direction 810, their outer footprint, for example their radial distance from centreline 183, increases. As such, when the seal plug 110 is pressed downwards, the clamping force may increase by an increased radial force with which the clamping member 802 are pressed against the inner wall of the liner 112.

Figure 19:
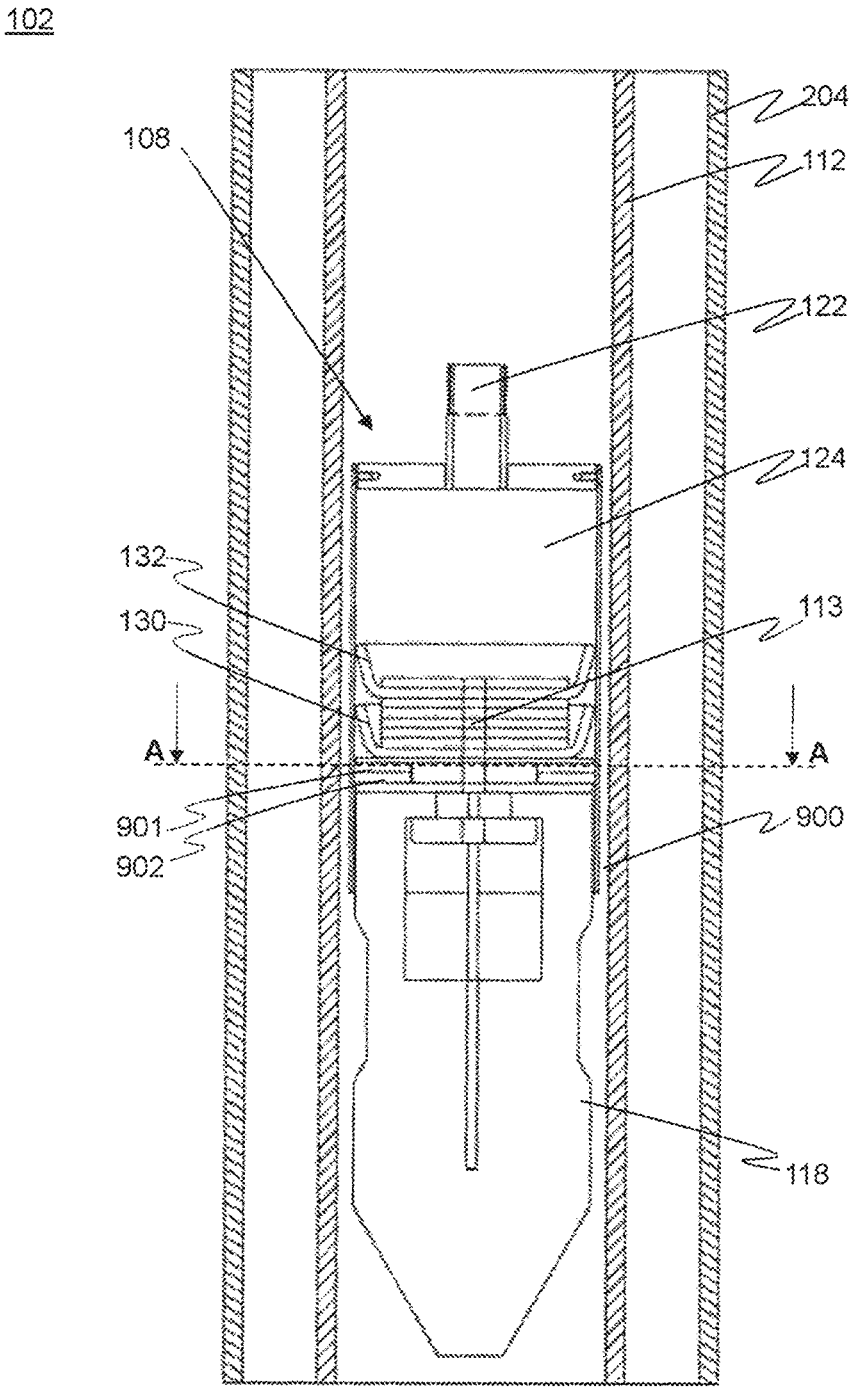
FIGS. 19 and 20 show another embodiment of a placement device in a well.
Figure 20:
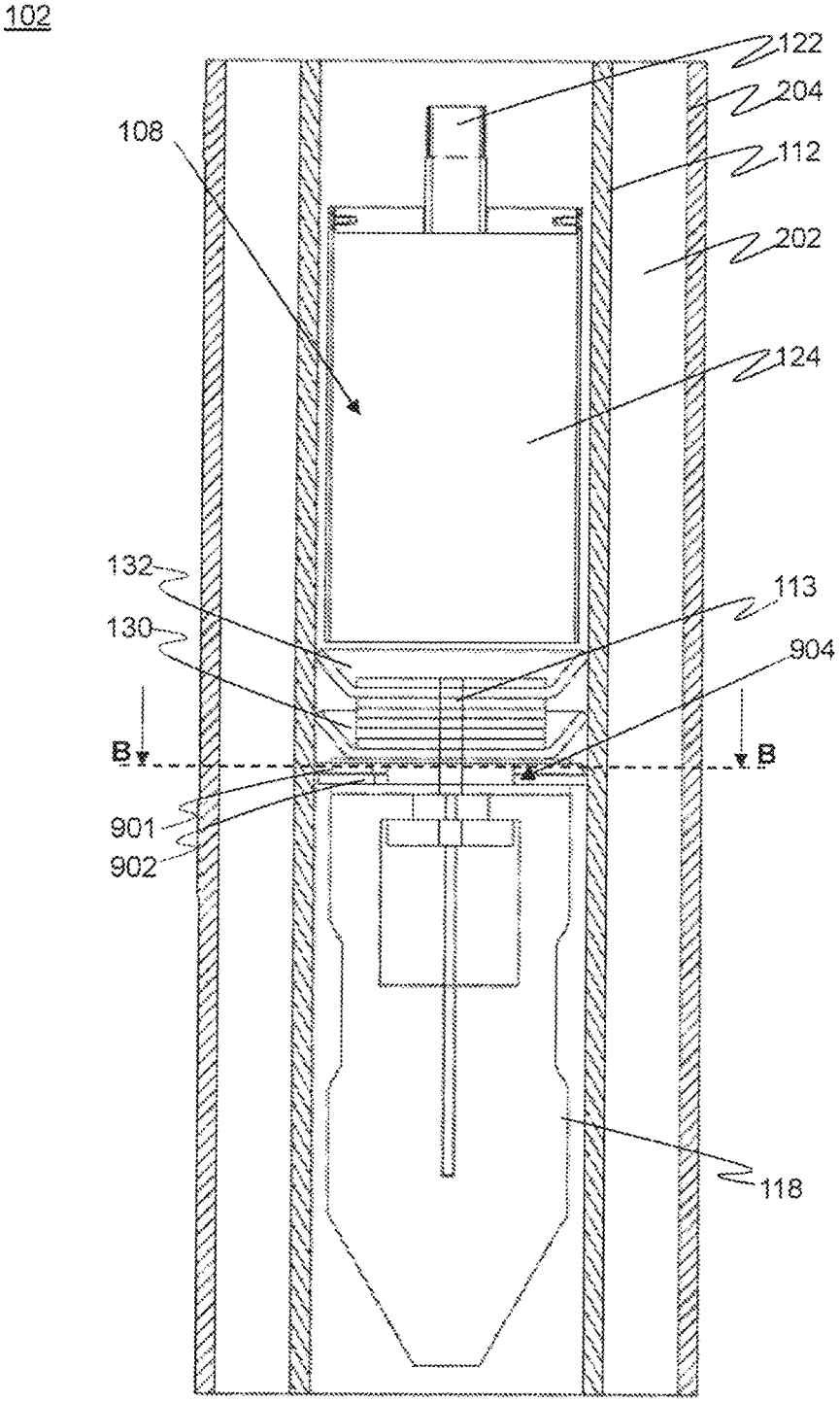
Figure 21A:
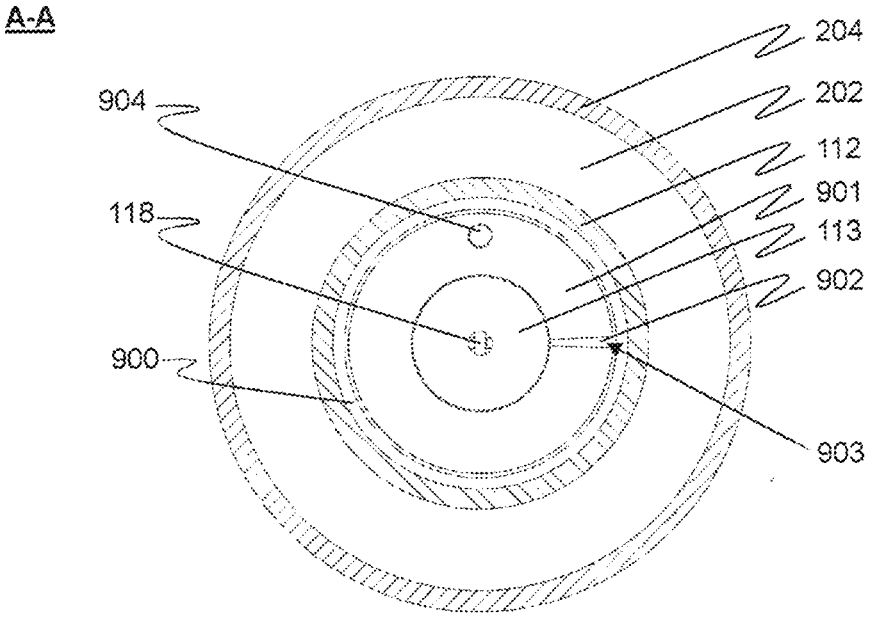
FIGS. 21A and 21B show section views of the placement device shown in FIGS. 19 and 20.
Figure 21B:
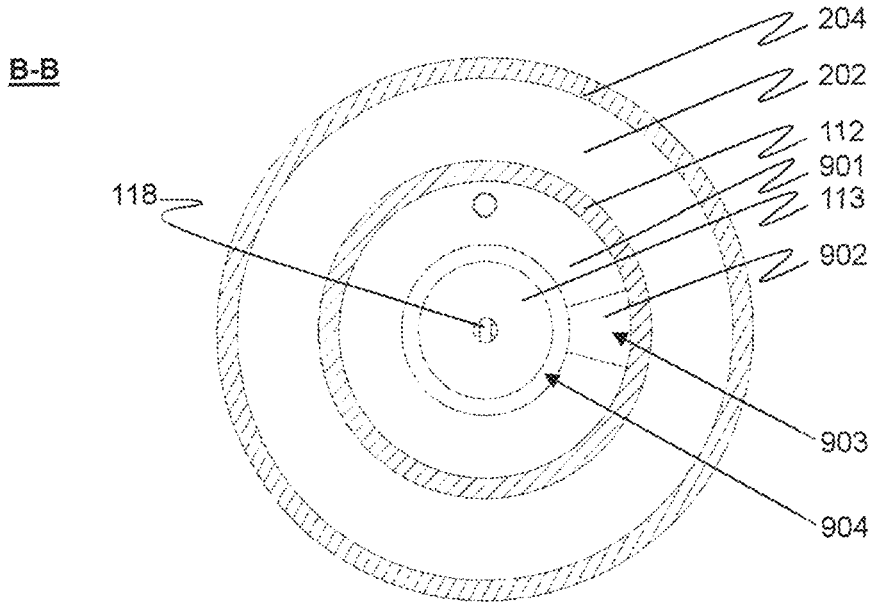

FIGS. 19 and 20 show in a section view another embodiment of a placement device 108 in the well 102. Not all elements shown in FIGS. 19 and 20 have been provided with a reference numeral. However, it will be appreciated that features disclosed herein, in particular in conjunction with FIGS. 2A and 2B, may be readily present in the embodiment of FIGS. 19 and 20, and vice versa. FIG. 21A shows a section view of the placement device 108 of FIG. 19, over line A-A. FIG. 21B shows a section view of the placement device 108 of FIG. 20, over line B-B. The sealant conduit 120 is omitted in FIGS. 19 and 20.

The placement device 108 is in FIGS. 19 and 21A shown with a radial clamping mechanism restricted by the restriction member 124 in a restricted state. In FIGS. 20 and 21B, the radial clamping mechanism is not restricted by the restriction member 124. As such, a gap 900 is present between the placement device 108 and the liner, when the radial clamping mechanism is in the restricted state. The gap 900 for example allows the placement device 108 to be lowered into the well 102 conveniently. The gap 900 between the radial clamping members and the liner is in the unrestricted state, depicted in FIGS. 20 and 21B, substantially closed, preferably fully closed—i.e. liquid-tightly closed.

In the particular embodiment of FIGS. 19, 20, 21A and 21B, the radial clamping mechanism comprises two split rings 901, 902, which may be similar to piston rings and may have a shape generally corresponding to a C-shape. Conceivably, any number of split rings may be used, including only one split ring. As visible in FIGS. 21A and 21B, the split rings may have an opening 903, which allows the split rings to be elastically deformed into a restricted state and positioned inside the restriction member 124. In the restricted state, the opening 903 is smaller than in the unrestricted state. In the unrestricted state, a split ring can radially engage the inner wall of the liner 102, and may as such clamp the seal plug in the liner and/or form an at least partial seal with the liner 102.

In the unrestricted state, a split ring may still be elastically deformed. A gap 904 may be formed in the unrestricted state between a split ring 901 and the protrusion 113, as depicted in FIGS. 20 and 21B. The protrusion 113 may have different cross-sectional dimensions over the length of the protrusion 113.

Preferably, the split rings 901, 902 are used in conjunction with one or more clamping members 130, 132, in particular clamping members made from resilient or elastic material, such as rubber. The split rings 901, 902 may prevent the clamping members in the unrestricted state from being pushed downward beyond the split rings 901, 902. It will be appreciated that the clamping members may be subject to a significant load for example due to fluid such as water or sealant pressing down on the clamping member 132 or clamping members, in particular at significant depths in the well. If the clamping members would be pushed downward too far, the seal between the clamping members and the liner may be lost. The split rings 901, 902 may be used to prevent the clamping members from being pushed downward too far and/or from being deformed in such as a way that a liquid-tight seal with the liner is lost. As such, in use, the split rings 901, 902 are preferably positioned below the clamping members 130, 132. It will be understood that any number of clamping members may be used in combination with any number of split rings, including only one clamping member and one split ring.

When multiple split rings are used, it is preferred to misalign the openings 903 of the split rings, such that the multiple split rings form a continuous surface preventing a clamping member to be pressed through the openings 903 of the split rings. For example in FIG. 21B, the second split ring 902 is shown positioned behind the opening 903 of the first split ring 901.

To prevent multiple split rings from rotating relative to each other, which may otherwise cause openings of the split rings to accidentally align, a pin 904 may protrude through the multiple split rings, which pin prevents this rotation and maintains the misalignment of the openings 903.

It will be understood that a split ring is disclosed herein as an example of a clamping member, which may be comprised by any embodiment of a radial clamping mechanism of any embodiment of a device for placing a seal plug in a liner of a well. A split ring, or multiple stacked split rings, may be used to form a circumferential seal against an inner wall of the liner in an unrestricted state and/or for clamping the seal plug in the liner. A split ring, or multiple stacked split rings, may be used on their own, or in conjunction with one or more other clamping members disclosed herein. A split ring may comprise a metal, and at least an outer radial surface of a split ring preferably has a low coefficient of friction with the restriction member to reduce the force required to push the split ring out of the restriction member.

In the description above, it will be understood that when an element is referred to as being "on" or "onto" another element, the element is either directly on the other element, or intervening elements may also be present. Also, it will be understood that the values given in the description above, are given by way of example and that other values may be possible and/or may be strived for.

Furthermore, embodiments of aspects may also be embodied with less components than provided in the embodiments described here, wherein one component carries out multiple functions. Just as well may embodiments be embodied using more elements than depicted in the Figures, wherein functions carried out by one component in the embodiment provided are distributed over multiple components.

It is to be noted that the figures are only schematic representations of embodiments that are given by way of non-limiting examples. For the purpose of clarity and a concise description, features are described herein as part of the same or separate embodiments, however, it will be appreciated that the scope of the aspects may include embodiments having combinations of all or some of the features described.

The word 'comprising' does not exclude the presence of other features or steps than those listed in a claim. Furthermore, the words 'a' and 'an' shall not be construed as limited to 'only one', but instead are used to mean 'at least one', and do not exclude a plurality.

A person skilled in the art will readily appreciate that various parameters and values thereof disclosed in the description may be modified and that various embodiments disclosed and/or claimed may be combined.

Aspects and embodiments thereof may be summarised in a non-limitative way by means of the following numbered embodiments:

1. Device for placing a seal plug in a liner of a well, the device comprising:
   - a seal plug arranged to form a circumferential seal against an inner wall of the liner in an unrestricted state, the seal plug comprising a radial clamping mechanism for clamping the seal plug in the liner, the radial clamping mechanism comprising at least one clamping member; and
   - a clamping mechanism restriction member for holding the radial clamping mechanism in a restricted state, wherein the radial clamping mechanism has a smaller outer footprint in the restricted state than in the unrestricted state;

wherein the restriction member comprises a hollow chamber with an inlet for receiving a flow of fluid and an outlet passage arranged to allow passage of the radial clamping mechanism, and the radial clamping mechanism is positioned at least partially in the hollow chamber between the inlet and the outlet passage.
2. Device according to embodiment 1, wherein the radial clamping mechanism comprises at least two clamping members, which are positioned at different distances from the inlet of the restriction member.
3. Device according to embodiment 1 or 2, wherein at least one clamping member is at least partially frustoconically shaped in the unrestricted state, and is arranged to be elastically deformed into the restricted state.
4. Device according to any of the embodiments 1-3, wherein at least one clamping member is connected to the seal plug with a biasing member arranged to bias the clamping member in the unrestricted state.
5. Device according to any of the embodiments 1-4, wherein at least one clamping member is arranged to form the circumferential seal against the inner wall of the liner in the unrestricted state.
6. Method for placing a seal plug in a liner of a well, the method comprising the steps of:
   - lowering a device for placing a seal plug into the liner of the well, in particular a device according to any of the embodiments 1-5;
   - providing a flow of fluid to an inlet of a hollow chamber of a restriction member of the device for placing the seal plug; and
   - allowing the seal plug to move relative to the restriction member by virtue of the hollow chamber becoming filled with fluid to release the seal plug into an unrestricted state wherein the seal plug forms a circumferential seal against an inner wall of the liner.
7. Method according to embodiment 6, wherein the seal plug comprises a radial clamping mechanism which in unrestricted state forms the seal with the inner wall of the liner to restrict fluid from flowing between the radial clamping mechanism and the inner wall of the liner.
8. Method according to embodiment 6 or 7, wherein the flow of fluid in provided to the inlet of the hollow chamber prior to or during lowering of the device into the liner of the well.
9. Method for abandoning a well, comprising:
   - placing a seal plug in a liner of the well, in particular according to the method according to any of the embodiments 6-8;
   - prior to or after the seal plug has been placed, severing or removing a section of the liner of the well, for example according to a method according to the second aspect; and
   - removing the severed section of the liner.

The invention claimed is:

1. A device for placing a seal plug in a liner of a well, the device comprising:

a seal plug arranged to form a circumferential seal against an inner wall of the liner in an unrestricted state, the seal plug comprising a radial clamping mechanism for clamping the seal plug in the liner, the radial clamping mechanism comprising at least one clamping member; and a clamping mechanism restriction member for holding the radial clamping mechanism in a restricted state, wherein the radial clamping mechanism has a smaller outer footprint in the restricted state than in the unrestricted state and in the unrestricted state, the radial clamping mechanism is no longer restricted by the restriction member;

wherein the restriction member comprises a hollow chamber with an inlet for receiving a flow of fluid into the hollow chamber and an outlet passage arranged to allow passage of the radial clamping mechanism out of the hollow chamber, and the radial clamping mechanism is positioned at least partially in the hollow chamber between the inlet and the outlet passage.

2. The device according to claim 1, wherein a temporary connection member is connected between the restriction member and the at least one clamping member, which temporary connection member prevents the at least one clamping member from being released from the restriction member when an insufficient force is provided to break or rupture the temporary connection member.

3. The device according to claim 2, wherein the temporary connection member comprises a resilient element.

4. The device according to claim 1, further comprising an air vent allowing air or other gasses to be vented from a space between the at least one clamping member and the restriction member.

5. The device according to claim 1, wherein the at least one clamping member is arranged to form the circumferential seal against the inner wall of the liner in the unrestricted state.

6. The device according to claim 1, wherein the inlet is provided with an inlet valve, arranged to restrict or block flow of fluid into the hollow chamber until a predetermined pressure is applied to the inlet valve.

7. The device according to claim 1, wherein a lid section is disconnectable from the restriction member, and the inlet is connected to the lid section.

* * * * *